United States Patent [19]

Thompson et al.

[11] Patent Number: 4,725,797

[45] Date of Patent: Feb. 16, 1988

[54] MICROWAVE DIRECTIONAL FILTER WITH QUASI-ELLIPTIC RESPONSE

[75] Inventors: James D. Thompson, Manhattan Beach; David S. Levinson, Woodland Hills, both of Calif.

[73] Assignee: Hughes Aircraft Company, Los Angeles, Calif.

[21] Appl. No.: 58,597

[22] Filed: Jun. 1, 1987

Related U.S. Application Data

[63] Continuation of Ser. No. 813,366, Dec. 24, 1985, abandoned.

[51] Int. Cl.[4] ..... H01P 1/208

[52] U.S. Cl. ..... 333/212; 333/21 A; 333/208; 333/230

[58] Field of Search ..... 333/208–212, 333/100, 132, 129, 136, 137, 21 R, 21 A, 230, 202, 227–235, 248, 238, 1, 108, 109; 370/38, 123

[56] References Cited

U.S. PATENT DOCUMENTS

| | | | |
|---|---|---|---|
| 2,890,421 | 6/1959 | Currie | 333/208 |
| 4,267,537 | 5/1981 | Karmel | 333/212 X |
| 4,396,896 | 8/1983 | Williams | 333/208 X |
| 4,410,865 | 10/1983 | Young et al. | 333/208 |
| 4,622,523 | 11/1986 | Tang | 333/208 |
| 4,630,009 | 12/1986 | Tang | 333/212 X |
| 4,652,843 | 3/1987 | Tang et al. | 333/212 |

FOREIGN PATENT DOCUMENTS 0104735 4/1984 European Pat. Off. .

OTHER PUBLICATIONS

IEEE Transactions on Microwave Theory and Techniques, vol. MTT-32, No. 11, Nov. 1984, (New York, US), Wai-Cheung Tang et al.: "A True Elliptic-Function Filter Using Triple-Mode Degenerate Cavities", pp. 1449–1454.

*Primary Examiner*—Marvin L. Nussbaum

*Attorney, Agent, or Firm*—S. M. Mitchell; M. J. Meltzer; A. W. Karambelas

[57] ABSTRACT

Circularly polarized radiation is tapped off from an input waveguide through a input iris into an entry cavity, where it is resolved into two orthogonal linearly polarized components. These respectively proceed along two discrete paths to an exit cavity. In each path six independently tunable resonances—traversed by both direct and bridge couplings—provides enough degrees of freedom for quasi-elliptic filter functions. In the exit cavity the resultants from the two paths are combined to resynthesize circularly-polarized radiation, which traverses another iris to the output waveguide. In one layout, four resonant tri-mode cavities form a rectangular array—with entry and exit cavities at diagonally opposite corners and intermediate cavities for the two discrete paths in the two remaining corners. In another layout, six dual-mode cavities form a three-dimensional array: entry and exit cavities stacked one above the other, and two intermediate two-cavity stacks for the two discrete paths adjacent the entry/exit stack.

50 Claims, 10 Drawing Figures

SYMBOLS

SLOT COUPLING IN WALL

CROSSED-SLOT COUPLING IN WALL

CIRCULAR-HOLE COUPLING IN WALL

MICROWAVE DIRECTIONAL FILTER WITH QUASI-ELLIPTIC RESPONSE

This application is a continuation of application Ser. No. 813,366 filed Dec. 24, 1985 now abandoned.

BACKGROUND

1. Field of the Invention

Our invention relates generally to microwave radio communications assembly and design, and more particularly to a relatively lightweight, compact, and inexpensive directional microwave filter that can be tuned to provide an elliptic filter function. Such filters have many applications, but are especially useful in frequency multiplexers and demultiplexers for communication satellites.

For purposes of this document, the term "microwave" encompasses regions of the radio-wave spectrum which are close enough to the microwave region to permit practical use of hardware similar to microwave hardware—though larger or smaller.

2. Definitions and Systems Considerations

This document is written for persons skilled in the art of microwave component assembly and design—namely, for microwave technicians and routine-design engineers.

Very generally, a multiplexer is a device for combining several different individual signals to form a composite signal for common transmission at one site and common reception elsewhere. Typically the several individual signals carry respective different intelligence contents that must be sorted out from the composite after reception; hence the multiplexing process must entail placement of some kind of "tag" on the separate signals before combining them.

The multiplexers of interest here are frequency multiplexers, in which the "tag" placed upon each signal is a separate frequency—or, more precisely, a separate narrow band of frequencies. Each signal is assigned a respective frequency band or "channel" and is transmitted only on that band, but simultaneously with all the other signals.

After reception the several intelligence contents are resegregated (demultiplexed) by isolating the components of the composite signal that are respectively in the assigned frequency bands. Each intelligence stream is thus directed to a respective separate device for storage, interpretation, or utilization.

In satellite operations the transmission is by radio through the ether, and all the signals are transmitted through a common antenna. Operations in the microwave region (as defined above are most customary.

A microwave frequency multiplexer generally consists of several frequency-selective devices, termed "filters," positioned along a combining manifold. Such a manifold is essentially a pipe or "waveguide" of rectangular or circular cross-section, through which microwave radiation propagates in ways that are well-known to those skilled in the art—namely, microwave technicians and design engineers.

Separate sources of intelligence-modulated but usually broadband microwave signals respectively feed the filters. "Broadband" means spanning a frequency band that is considerably broader than the narrow band assigned to each intelligence channel. Usually each source feeds its respective filter through another short piece of waveguide.

The details of generating these broadband signals and modulating them with intelligence that is to be transmitted, as well as the details of the transmission and reception process, are outside the scope of this document. The means used for demultiplexing after reception, however, are within the present discussion. At least in principle, most multiplexers if simply connected up in the reverse direction act as demultiplexers. As will be seen, however, demultiplexers for ground stations or for very large craft are not subject to such mass and size constrainsts as demultiplexers for communications satellites. For simplicity in most of the discussion that follows, we refer only to multiplexers.

Each of the several filters in a multiplexer is assigned a frequency band generally different from that which is assigned to all the others. Each filter is constructed and adjusted so that it permits most of the microwave radiation within its band to pass on into the manifold—and so that it stops most of the radiation outside its band (in either direction along the frequency spectrum). These two frequency categories with respect to any particular filter are accordingly sometimes called the "pass band" and "stop band" of the filter.

Design requirements for multiplexers on spacecraft include several constraints which have been extremely difficult to satisfy in combination. Although particularly troublesome in communications repeater satellites and the like, many of these constraints are common to multiplexers and filters generally, as will be seen.

First, it is highly desirable to minimize the overall weight and bulk of spaceflight equipment, with reasonably low cost. This consideration is particularly important to bear in mind because heretofore the best solution for most of the other constraints in this field has required such high overall weight, bulk, and cost as to be completely unacceptable.

Second, it is highly desirable to minimize both the overall use of electrical power and the dissipation of electrical power as heat within communications components. The overall power to the communications system must be supplied from the spacecraft power supply, which is severely limited. Overall power includes not only the desired output power to the antenna, but also the dissipation losses in components, including filters. Moreover, each instance of significant heat dissipation complicates the overall thermal-balance design of the craft. Both these considerations favor components, including filters, that dissipate very little power. In other words, it is preferable to use filters with very high "Q" or quality.

Third, it is desirable that all of the sources make essentially equal power contributions to the composite signal. Otherwise the overall power to the antenna must be increased as required to transmit the weakest channel stream with an adequate ratio of signal to background noise, and this increase wastes power in all the other channels.

This channel-equalization consideration is very closely related to the low-dissipation concern discussed above, but only in certain cases. The operating principle of some filters requires a multiplexer layout in which the output of one filter passes through other "downstream" filters en route to the antenna. In such a multiplexer the dissipation which each other filter imposes upon the signal from the upstream filter is cumulative. Signals from upstream filters are subject to more power loss in dissipation than signals from downstream filters. Consequently to the extent that the individual filters are dissipative the source power in different channels is differently attenuated, or unequalized, in approaching the antenna.

Channel equalization is of relatively small importance, because inequalities in the coupling between each source and the antenna can be compensated by adjusting the power outputs of all the sources. Nonetheless, a practical convenience of some value is obtained by using a multiplexer system that intrinsically produces interchannel power equalization. Some filter types have this property intrinsically and others do not.

Fourth, symmetrical distribution of both weight and thermal dissipation is very desirable in spacecraft. Without such symmetry the control of maneuvers and of thermal balance are more severe problems. These considerations not only accentuate the desirability of low overall weight, low overall electricity consumption and low dissipation in individual components, but also place a premium upon the designer's freedom to position sizable electronic components arbitrarily. Hence it is desirable to be able to position multiplexer filters at will along the multiplexer manifold. Such arbitrary positioning is possible with certain kinds of filters but not others, as will be detailed below.

Fifth, it is extremely desirable to provide filters that can be both positioned and tuned independently of one another. Otherwise installation and adjustment are an extremely delicate, protracted and sometimes iterative procedure, contributing significantly to the overall cost of the apparatus. Here too, certain types of filters are nearly independent of their neighbors along a multiplexer manifold, while other types are not.

Sixth, in virtually all spacecraft communications applications, practical economics requires providing as many communications channels as possible within the overall waveband of the spacecraft transmitter. This condition has led to routine specification of rather narrow wavebands for each channel, and even more significantly to very narrow "guard" bands—unused frequency bands that separate the channels to avoid crosstalk between adjacent channels. In other words, close spacing of frequencies in the frequency-multiplexer overall frequency band is nowadays a fixed requirement.

Consequently filters must be used that provide good isolation of adjacent channels even though their spacing in the frequency spectrum is very slight. This means that it is necessary to inquire into the precise manner in which the signal-passing properties of a filter change with frequency. If the transmission of a filter is plotted against frequency, the resulting graph or curve illustrates the "filter function" or "shape" or "cutoff characteristic" of the filter. These are of crucial importance.

Ideally such a graph shows very high values of transmission within the passband and very low values elsewhere. Further, in such a graph the lines at both edges of the passband, connecting the high-transmission portion of the characteristic curve in the passband with the low-transmission portions elsewhere, ideally are almost vertical. In other words, the ideal filter provides a very sharp "cutoff."

Of course the same ideas can be expressed in terms of a graph of attenuation vs. frequency: the ideal filter function shows very low values of attenuation in a "notch" region defining the passband, very high attenuation at both sides, and essentially vertical lines representing the sharp cutoff characteristic at both sides of the notch.

Certain types of filters, but not others, provide adequate attenuation and adequately sharp cutoff for satellite microwave communications.

3. Prior Art

A basic microwave filter consists essentially of a resonant chamber—typically a metallic cylinder, sphere, or parallelepiped—that is made to support an electromagnetic standing wave or resonance in the contained space.

As is well-known, electromagnetic energy at any frequency has an associated wavelength and tends to resonate in a chamber whose dimensions are appropriately related to that wavelength. A filter chamber or cavity is constructed to approximately correct dimensions for a desired resonant frequency and is then tuned, generally by adjustment of tuning "stubs" or screws that protrude inwardly into the chamber, to vary the electromagnetically effective dimensions.

A single resonant cavity, when used to support within it a single electromagnetic resonance, works only in an extremely narrow band of frequencies. In the ideal "lossless" resonator the frequency band is theoretically infinitesimal. In any practical resonant chamber, however, there are some losses—due to electrical conduction induced in the chamber walls by the electromagnetic fields in the contained space—and associated with these losses is a very slight broadening of the frequency band of the individual resonating chamber.

If broadband microwave power is introduced into such a chamber (through an entry iris, for instance) whatever portion of the input power is oscillating at frequencies within the frequency band of the chamber will "excite" the chamber. In other words, such power is capable of accumulating as energy in an electromagnetic standing wave within the chamber. Some of this energy may be drawn out of the chamber (through a suitably positioned exit iris, for instance) as narrowband power. Whatever portion of the input power is oscillating at frequencies outside the frequency band of the chamber will not excite the chamber significantly, and cannot be drawn off in significant quantities. The chamber simply rejects such vibrations.

Taking a conceptual overview of such a chamber (and its two irises, or equivalent input and output features), the chamber operates as a filter—permitting only power in a narrow frequency band to pass from entry to exit. A standard treatise describing the theory and some practical procedures for assembly and adjustment of microwave filters is Matthaei, Young and Jones, *Microwave Filters, Impedance-Matching Networks, and Coupling Structures* (McGraw-Hill 1964, reprinted Artech House, Dedham Mass. 1980). A useful reference work is Saad, Hansen and Wheeler, *Microwave Engineers' Handbook* (two volumes, Artech House 1971).

In practice two or more such chambers are generally assembled to form a series of resonators. If the individual chambers are tuned to slightly different frequencies, the overall assemblage supports a resonance that is slightly degraded but that extends over a frequency range which is significantly broadened, encompassing the two or more frequency ranges of the different chambers. This broadening may be useful in various ways—for instance, to accommodate frequency drift with temperature, or Doppler shifts due to relative velocity of transmitter and receiver.

Broadband microwave power may then be introduced into, for example, one end of the series of chambers, and that portion of the power that is oscillating at a frequency within the broadened passband can be drawn away from, for example, the other end of the series of chambers.

The technique used for coupling power from a filter to a manifold or other waveguide is very important to multiplexer performance. Before 1957 the best available arrangement was the "short-circuited manifold." This technique made use of a well-known property of resonator cavities, not only electromagnetic but also acoustic and other types. A solid wall can be placed completely across such a chamber without interfering with the resonance, provided that the wall is positioned at a "node" of the resonance—in other words, at a point where the standing wave is always zero anyway.

This condition is satisfied, for example, by "driving" the resonance (pumping energy in) at a distance of one-quarter wavelength from the wall, where the corresponding standing wave should have a maximum. Several resonances at respective different frequencies can be established in the same resonator by supplying the driving energy at the corresponding quarter-wavelengths from the end wall. Such multiple resonances can be present one at a time, or—with certain modifications—simultaneously.

In the microwave field an end wall is electrically a short circuit; hence the term "short-circuited manifold." To form a multiplexer using this configuration, each filter must be positioned, in effect, a quarter-wavelength from the short-circuiting end wall. Since different frequencies correspond to different wavelengths, the various filters are at slightly different distances from the wall.

This elementary configuration has several advantages. For one, no extra components are required to couple the filters to the manifold. Weight, bulk and cost therefore are moderate, and can be minimized by modern techniques which use each chamber for two or even three different resonances—"dual mode" or "tri mode" cavities.

Though dual-mode filters were proposed by Ragan in 1948 (*Microwave Transmission Circuits*, MIT Radiation Laboratory Series 9 673–77, McGraw-Hill), a first practical realization of such filters seems to have been introduced by Atia and Williams, in a paper entitled "New Types of Waveguide Bandpass Filters for Satellite Transponders," *Comsat Technical Review* 1 21–43 (fall 1971).

Similarly, tri-mode filters were described by Currie in 1953 ("The Utilization of Degenerate Modes in a Spherical Cavity," *Journal of Applied Physics* 24 998–1003, August 1953), but a practical two-cavity tri-mode filter remained to be disclosed by Young and Griffin in U.S. Pat. No. 4,410,865, issued in 1983.

In multiplexers using the short-circuited-manifold technique the dissipation is also low, and very little of the power from each filter passes through any of the other filters; hence there is no serious interchannel power imbalance.

Thus the short-circuited-manifold technique performs satisfactorily with respect to the first three considerations discussed in the preceding section.

Furthermore, the short-circuited-manifold technique is amenable to extremely sophisticated modern methods for shaping the attenuation notch of each filter. These methods provide sharp cutoffs and thereby permit very narrow guard bands.

More specifically, these methods entail providing not just one sequence of couplings between the multiple resonances in a series of resonant chambers, but two or even several different "routes" from one resonance in the series to later resonances. The complete series, taken one step at a time from the entry resonances to the exit resonance, is usually called the "direct" coupling sequence. Some couplings in these modern systems, however, jump across what could be called "shortcuts" between two resonances in the direct-coupling sequence. These couplings are usually called "bridge" couplings.

When the bridge couplings are suitably designed, they produce resonances that are in the same orientation and location as those produced by the direct couplings, and of nearly equal amplitude, but exactly out of phase. The sum of these two resonances is a single standing wave of very small amplitude—or, in other words, a single resonance that is very strongly attenuated. The diametrical phase difference is thus used to construct a transmission node—an attenuation maximum—in the response of the overall cavity assemblage. In practice, not one but two such attenuation maxima are forced to occur at certain frequencies immediately adjacent to the minimum-attenuation notch. In this way a very sharp cutoff is sculpted at each side of the notch.

Details of these bridge-coupling techniques are set forth clearly in the above-mentioned disclosures of dual- and tri-mode filters, and in other works. The sharp cutoffs achieved are generally called "elliptic" filter functions, since the mathematical functions known as "elliptic functions" can be used to construct the corresponding graphs. Similar performance, however, can also be obtained with "quasi-elliptic" filter functions. These are polynomials arbitrarily constructed by numerical methods; their coefficients do not correspond to any established mathematical function, but are selected simply because they yield the desired microwave filtering results.

The short-circuited-manifold technique thus performs admirably in regard to the sixth consideration discussed above, as well as the first three. It does, however, present two major problems.

First, the filters in a short-circuited-manifold multiplexer are necessarily fixed in location relative to the short-circuiting wall, and in practice they are very close to one another. Symmetrical weight and dissipation distribution of a unitary multiplexer is therefore impossible.

Further, and even more troublesome, the operation of each filter is perturbed by the operation of all the others, so that the actual distance of each filter from the end wall must be an "effective" quarter-wavelength that differs substantially from the distance for that filter operating alone.

These effective quarter-wavelengths must be worked out either by a theoretical analysis (which is typically subject to variation in the actual hardware or by an iterative process of adjusting and readjusting all of the filters in turn. Even when that has been done, variations in the relative operating levels of the sources in the several channels can change the effective quarter-wave positions. Consequently the best solution is only a sort of compromise for typical or average operating levels.

Positioning and tuning independence, as well as symmetrical weight and dissipation distribution, is therefore unavailable in this otherwise useful technique. Many workers have sought a configuration which could provide the missing advantages.

In 1957 Conrad Nelson introduced a "new group of circularly polarized microwave cavity filters" which in fact possessed these advantages ("Circularly Polarized Microwave Cavity Filters," *IRE Transactions on Microwave Theory and Techniques*, Apr. 1957, 136–47).

When properly positioned relative to an input waveguide through which suitable electromagnetic radiation is propagating, a Nelson filter receives circularly polarized radiation from that waveguide through an entry iris. A Nelson filter also presents circularly polarized radiation of the same sense at an exit iris.

It does so, however, in a frequency-selective manner Speaking generally, radiation that is within the frequency "passband" of such a filter is coupled through the filter appearing as circularly polarized radiation at the exit iris, but other radiation is simply rejected at the entry iris and continues along the input waveguide.

When an output waveguide is also properly positioned at the exit iris, there is established in the output waveguide a propagating radiation pattern that has the same direction of propagation as the source radiation in the input waveguide.

Hence Nelson provided a three-port device. Broadband radiation enters along one waveguide from one direction (the "origin" end of the input waveguide serving as an input port), and radiation in the stop band continues straight along the same waveguide in the same direction the "destination" end of the same waveguide guide serving as an output port). Radiation in the pass band takes a dogleg "jog" (and in some configurations turns a corner) and leaves the filter through a second waveguide, which serves as an output port. Since the direction of propagation in all three ports is completely defined, such a filter is often called a "directional" filter.

Four key facts make Nelson's filter practical. First, on the broad face of nearly every rectangular waveguide there are two lines, parallel to the length of the guide, which represent positions of circular polarization inside the guide. These loci are spaced a known and readily measured distance from the narrower face of the guide. Appropriately shaped irises drilled through the broad face of the guide at any point along either line will tap circularly polarized radiation out of the waveguide.

Second, circularly polarized radiation coupled into Nelson's filter cavity through an iris in the cavity wall can be resolved into its two constituent linearly polarized components for purposes of establishing standing wave structures within the cavity.

Third, these linearly polarized components can be recombined at another point on the cavity wall to resynthesize circularly polarized radiation, which in turn can be tapped out of the resonant cavity through an iris at this other point into an output guide.

Fourth, the circularly polarized radiation can be coupled into another waveguide along one of the circular-polarization loci to reconstruct a propagating wavefront representing power flow along the guide.

Now as to multiplexer construction, several of Nelson's filters can be laid out with a single continuous manifold pipe serving as the output waveguide for all of the filters in common. The several filters all feed this single continuous waveguide in parallel. The power from all of the filters accordingly comes together for the first time in the combining manifold. Power for each channel thus passes through only one filter.

Most properties of Nelson's directional filters are highly favorable for applications of interest here. In particular, these filters have exceedingly low weight, bulk, cost, and electrical dissipation (high Q).

If it were necessary to pass power for some channels through filters for other channels, interchannel equalization using Nelson's directional filters would nevertheless be good, since their dissipation is so low. Not even this minor imbalance, however, is incurred since power for only one channel passes through each filter proper.

Power for all of the channels—whether they are upstream or downstream along the manifold—at most merely passes by the exit irises of filters for other channels. In these transits there is essentially negligible coupling to those other filters and negligible power loss. Interchannel equalization is therefore an intrinsic advantage of the Nelson directional filter.

Furthermore, the Nelson filter may be positioned at any point longitudinally along the input waveguide and also at any point longitudinally along the band-pass output waveguide (i.e., the manifold), provided only that it is positioned at the correct point transversely with respect to each waveguide.

That correct point is anywhere along the respective loci mentioned earlier, where circularly polarized radiation may be (1) tapped off from radiation propagating along the input waveguide, and may be (2) inserted into the output waveguide to reconstruct radiation propagating along the output waveguide. This restriction is very easily met, since it requires only centering a coupling iris at a measured distance from either side of the waveguide.

Thus Nelson's filters perform very well as to the first five considerations outlined in the preceding section. Unfortunately, however, they fail in regard to the sixth.

The Nelson devices are incapable of being tuned to provide elliptic or quasi-elliptic filter functions. Their optimal operation is achieved with tuning to provide a filter function that is known variously as a "Tchebychev," "Tchebyscheff" or "Chebyshef" function—and this function offers less sharp cutoffs than the elliptic or quasi-elliptic functions.

If only the width of the frequency interval of minimum attenuation (maximum transmission) is taken into account, the Tchebychev function provides an adequately narrow passband. The very bottom of the "notch" shape on the attenuation graph is sufficiently narrow, and it is otherwise suitable.

Turning to the shape of the notch at slightly higher attenuation (lower transmission) values, however, the "cutoff characteristic" is found to be unacceptably broad or shallow in profile. With a Tchebychev filter function, excessive power is leaked from each channel into the adjacent frequency regions—introducing either an unacceptably wide guard-band design requirement or excessive crosstalk.

Thus while the short-circuited-manifold technique suffers from inflexible and interdependent positioning requirements, Nelson's configurations suffer from inadequate sharpness of cutoff. It has been well established in the literature that these respective deficiencies are unavoidable intrinsic drawbacks of the operating principles involved in these devices.

The reason, in fact, for inability of the Nelson concept to yield elliptic filtering is closely tied to its very advantages. The input circularly polarized radiation at the entry iris is resolved within the filter cavity into its constituent horizontally and vertically polarized components. In all of Nelson's many designs, the cavity treats these two components identically—and it has appeared that they must be so treated, since they recombine at the exit iris to resynthesize circularly polarized radiation. The resynthesis must be exact to obtain nearly pure circular polarization, and this in turn is required to avoid loss or reflection in the recoupling of circularly polarized radiation out to the output waveguide to reconstruct a wave propagating toward the antenna.

No one has been able to perceive any way of providing bridge couplings for the linearly polarized components within Nelson's unitary cavity, without destroying their characteristic and crucial recombinability. In effect there appears to be a sort of conceptual trap associated with Nelson's appealingly convenient technique of coupling circularly polarized radiation from any point along the source loci: once coupled into the filter, if the circularly polarized radiation is to be resynthesized at an exit iris it is beyond reach, or at least not to be disturbed.

In the literature, however, there appears one other type of directional filter capable of elliptic or quasi-elliptic filter functions. This device is due to Gruner and Williams, who introduced it as "A low-loss multiplexer for satellite earth terminals," *Comsat Technical Review* 5 157–77 (spring 1975).

Gruner and Williams avoided the seeming trap of the Nelson circular-polarization system, starting instead with a linearly polarized propagating radiation pattern that is frontally collected as it moves through a waveguide. They first direct this wavefront into one port of a device known as a "hybrid" or "quadrature hybrid." This hybrid is used as an input device for the Gruner and Williams filter assembly.

A hybrid is a four-port device which has two key properties. For definiteness of discussion the ports of a hybrid will be identified as ports number one through four. The first essential property of a hybrid is that a wavefront entering at port one is split into two equal wavefronts of different phase, and emitted with a well-defined phase relationship at ports three and four. The device works in reverse as well—that is, two equal wavefronts in correct phase supplied at ports three and four are combined into a single wavefront and emitted at port one.

If wavefronts emitted at ports three and four are reflected, however, by devices placed at these ports, due to the phase reversal in reflection the phase relationship of the two reflected wavefronts is incorrect for return of the power to port one. Rather, and this is the second essential property of a hybrid, the reflected power flows out through the remaining port—port two—of the hybrid.

In the system of Gruner and Williams, the two equal power flows leaving the hybrid separately at ports three and four reach two respective filters, each capable of elliptic or quasi-elliptic function. The broadband power in the stop band is reflected from these filters and leaves the hybrid at port two—where it is absorbed in an attenuator provided for the purpose. The power in the pass band, however, proceeds through the filters. As the filters are identical they preserve the phase relationship between the two wavefronts.

The pass-band output wavefronts from the two filters then enter ports three and four of another hybrid, which for definiteness we will call the "output hybrid." The output hybrid recombines the output wavefronts into a single wavefront having a narrow frequency band, and directs the single wavefront out through port one and into an output waveguide, propagating in a particular direction toward the antenna.

Since the Gruner and Williams system is directional, it has some potential for avoiding the positioning limitations of the short-circuited-manifold technique and therefore is of interest for multiplexer construction. Each channel of such a multiplexer requires an input hybrid and an output hybrid, as well as two complete elliptic-function filter assemblies.

The basic principle of this system is in a very abstract sense analogous to that of Nelson: a propagation direction of a single signal is translated into a phase relationship of two component signals, and the phase relationship is subsequently translated back into a propagation direction for the recombined signal. Between the two translation steps, however, for purposes of bridge-coupling filter procedures there is a crucial difference: the two component signals are inextricably associated with each other and therefore inaccessible in Nelson, but separated and therefore accessible in Gruner and Williams.

In a Gruner and Williams multiplexer the output power from each output hybrid does not proceed directly to the antenna, unless the hybrid under consideration happens to be that one which is geometrically nearest the antenna. The power from any upstream output hybrid is directed instead into port two of a respective adjacent output hybrid. For definiteness this latter will be called the "second hybrid." Since this power is in the stop band of the filters associated with the second hybrid, the power is reflected from the filters and leaves the second hybrid at port one.

As will be recalled, it is port one through which the output power from the filters associated with this second hybrid is emitted. Consequently the power from two channels is combined at port one of the second hybrid. If this power in turn is similarly directed into port two of yet a third output hybrid, adjacent to and further downstream from the second hybrid, the power from three channels will appear at port one of this third hybrid.

Thus there is no combining manifold as such; rather the power flows for the several channels are accumulated by successive passage through the corresponding output hybrids. This system attains two of the principal advantages of directional filters—arbitrary positioning of the hardware for the several channels, and a degree of tuning independence.

There are, however, two serious drawbacks. Although the filter cavities themselves can be made very compact and light by the plural-mode technique mentioned earlier, the hybrids are bulky and heavy. It is for this reason that Gruner and Williams offered their innovation as an "earth terminal." For this reason alone the hybrids would be impractical for satellite applications.

In addition, the hybrids are very costly, and have relatively high dissipation loss—as compared with either the short-circuit technique or the circular-polarization couplings of Nelson. While this loss may be negligible with respect to overall power consumption, it is significant with respect to the spatial distribution of heat dissipation. The cumulative way in which the system collects signals from the several channels by passage through the output hybrids leads to highest power flow in the "downstream" output hybrids. Dissipation is therefore distributed in a very nonuniform fashion, being concentrated in the downstream output hybrids.

Dissipation loss in the output hybrids is also significant with respect to interchannel equalization. The cumulative collection of signals leads to greatest signal loss in the signals from the upstream hybrids. The power level in the signal sources feeding the upstream filters must therefore be adjusted to compensate.

In summary, the Gruner and Williams system satisfies the fifth and sixth considerations mentioned in the preceding section—tuning independence and sharpness of cutoff. In purest theory it also satisfies part of the fourth consideration, weight distribution: the hardware for each channel can be separated by arbitrary distances from the hardware for other channels. This theoretical benefit is not useful, however, since the weight to be distributed is excessive. As to the first three considerations and the other part of the fourth, heat distribution, the Gruner and Williams system is unacceptable for efficient spacecraft design.

No prior system operates satisfatorily with respect to all six considerations outlined above. Weight bulk, and sharpness of cutoff generally have been accorded the highest priority, leading to use of the short-circuited-manifold technique in most modern satellites—despite the associated asymmetry of weight and dissipation, and interdependence of tuning.

SUMMARY OF THE DISCLOSURE

Our invention is a directional filter for frequency-selective coupling of circularly polarized electromagnetic radiation from an input waveguide to an output waveguide.

In one preferred form or embodiment, our invention includes an entry resonant cavity that is coupled to accept the circularly polarized radiation from the input waveguide. One convenient way to provide this coupling is to tap circularly polarized radiation out of the input waveguide through a circular iris defined in the waveguide at some point along the loci mentioned earlier. This entry cavity is adapted to resolve the circularly polarized radiation into first and second mutually orthogonal linearly polarized components.

This form of the invention also includes first and second intermediate resonant cavities, which are physically distinct from one another. These cavities are coupled to receive the first and second mutually orthogonal linearly polarized components, respectively, from the entry cavity.

It is perhaps at this point that our invention first departs abruptly from the Nelson configuration: part of our invention consists in the recognition that there really is no "conceptual trap" in the Nelson filter. As will be appreciated, this recognition runs directly contrary to the teaching of the prior art. In fact the coupling of circularly polarized radiation into an entry cavity and the resolution of that radiation into two orthogonal linearly polarized components can be followed straightforwardly by separate processing of those two components. If it is desired to resynthesize circular polarization later, however, care must be taken to preserve the necessary amplitude and phase relationships at the output points of the separate processes.

This form of our invention also includes some means for coupling some of the radiation component received in each intermediate cavity to form a modified component that is orthogonal to the received component. For definiteness we will refer to the hardware that performs this task as "coupling means."

The modified component in each intermediate cavity may be linearly polarized in a direction that is orthogonal to the direction of linear polarization of the received component; however, this is not the only type of "orthogonal" modified component that is contemplated. The modified component may instead be a substantially independently tunable harmonic or subharmonic of the received component, or it may be a different resonant mode (for example, transverse magnetic rather than transverse electric).

Yet other kinds of orthogonal modified component may be possible, and we consider all such possibilities to be within the scope of our invention. For generality we will use terms such as "orthogonal components," "orthogonal modes" or "orthogonal" to encompass the three possibilities specifically mentioned above as well as others. (When we refer specifically to "orthogonal linearly polarized components" as in the entry and exit cavities, however, we mean to limit the reference to simple geometric orthogonality—in other words, to linearly polarized components that are polarized in mutually perpendicular directions.)

The "coupling means" mentioned above will include, in this form of our invention, first and second coupling means that are respectively associated with each of the first and second intermediate cavities. These coupling means are for coupling some of the radiation component received in each of those intermediate cavities to form first and second modified radiation components respectively. These modified components are formed within the respective intermediate cavities and as already mentioned are orthogonal to the respective received linearly polarized components.

This form of our invention also includes an exit resonant cavity. It is coupled to admit the first and second modified radiation components from the respective first and second intermediate cavities—or, equivalently, components respectively developed from those modified radiation components.

As will be seen, interposition of additional cavities in series with the intermediate cavities is within the scope of our invention, and has the effect of permitting either more controllably shaped filter functions or the use of fewer resonances per cavity. In such cases, the exit cavity admits components developed from the modified components, rather than the modified components directly. It is in this limited sense that the admission of components developed from the modified components may be regarded as equivalent to the admission of the modified components themselves.

The exit cavity is adapted to synthesize circularly polarized radiation from the admitted components, for coupling to the output waveguide. Such output coupling may be effected conveniently by an iris formed in the output waveguide at some point along the loci described earlier.

Preferably, the various cavities mentioned above have additional coupling means of several sorts for constructing other resonances in a sequence between the input waveguide and the output waveguide. Such additional coupling means and resulting resonances will be detailed in a later section of this document. In general, however, these resonances should form a "direct coupling" sequence, and preferably the coupling means provide for "bridge couplings" between certain resonances. Such a system can be used to produce transmission nodes—attenuation poles—for sculpting sharp-cut-off filter functions such as elliptic or quasi-elliptic functions.

In designing the two parallel resonant sequences, as previously mentioned, it is essential to preserve the input phase and amplitude at the output. It is not at all necessary, however, to equalize phase and amplitude as between the two sequences at each step along the way. In fact one of our most preferred embodiments lacks such stepwise equalization. As will be shown later, one useful way to produce overall equalization is to make the two paths inverses, rather than direct copies, of each other.

Our invention can be realized in many ways. Generally, however, in this first form of our invention the entry and exit cavities are common to two distinct coupling paths that start with the two mutually orthogonal linear polarization components of the input circularly polarized radiation, and that end with the two mutually orthogonal linear polarization components of the output circularly polarized radiation.

This form of our invention is extremely weight efficient, bulk efficient and cost effective since the entry and exit cavities are each a part of the two paths—serving as resonators and also serving to resolve the circularly polarized input radiation into component parts and to resynthesize circularly polarized output radiation from component parts. No additional hardware is required at either end of the paths for resolution or resynthesis.

Similarly there is no significant power consumption or dissipation anywhere in this form of our invention that would be absent in the equivalent filters considered alone, without the multiplexer couplings. This is an advantage which our invention shares with the Nelson device, and for the reason that we use the same waveguide-coupling principle. For the same reason, interchannel power equalization is an inherent feature of this form of our invention.

Because of the directional property of this form of our invention, hardware for the various channels may be positioned arbitrarily along a combining manifold to optimize weight and heat-dissipation distribution. In operation, adjacent filters are almost completely independent of other filters, particularly those upstream; consequently tuning is nearly independent and can be accomplished noniteratively by starting at the upstream end of the system.

Finally, by virtue of the separate processing of signals in the two distinct paths, this form of our invention permits achievement of elliptic or quasi-elliptic filter functions. Our invention is thus the first to perform satisfactorily with respect to all six of the system considerations established earlier.

Our invention can take other forms, which may overlap with the description presented above. In particular, another preferred embodiment of our invention includes an array of at least four resonant cavities—including an entry cavity, an exit cavity, and at least first and second intermediate cavities. Each of these cavities supports electromagnetic resonance in each of three mutually orthogonal modes during operation of the filter.

The entry and exit cavities together with the first intermediate cavity (and mode-selective irises between the cavities) define a first path for transmission of radiation from the entry cavity to the exit cavity. Analogously the entry and exit cavities together with the second intermediate cavity (and irises) defines a corresponding second path; this second path is for transmission of radiation from the same entry cavity, and to the same exit cavity, as the first path. Radiation in the first and second paths is combined, during operation, in the exit cavity. Each of the first and second paths is independently configured to provide a filter function as between radiation in the entry cavity and radiation in the exit cavity.

To the best of our knowledge there has never heretofore been a tri-mode, dual-discrete-path microwave filter, particularly one in which the two discrete paths share use of both the entry and exit cavities. In this connection, by specifying that the two paths are discrete we do not mean to rule out the mere use of beginning or ending steps in either resonant sequence which are within the entry or exit cavity, respectively—so long as there is at least some part of each path that is not common to the other path.

Preferably in this second form of our invention the filter function provided in each of the first and second paths is elliptic or quasi-elliptic. Preferably the two functions are substantially the same.

Preferably this form of our invention contains precisely four cavities and no more—namely, the entry and exit cavities and precisely two intermediate cavities. This configuration is particularly preferable because it provides elliptic or quasi-elliptic response shaping that is completely adequate for virtually all modern requirements with an absolute minimum of hardware.

Yet another preferred form of our invention includes a substantially rectangular array of at least four resonant cavities. This array includes an entry cavity and an exit cavity occupying respective corners of the array that are diagonally opposite one another. These two cavities are particularly adapted, respectively, to receive radiation from an input waveguide and to direct radiation into an output waveguide. The array of this third form of our invention also includes first and second intermediate cavities that occupy the remaining corners of the rectangular array.

All four cavities in this form of our invention operate in three mutually orthogonal modes. The entry and exit cavities together with the first intermediate cavity (and irises) defines a first path for transmission of radiation from entry to exit cavity. Similarly the entry and exit cavities together with the second intermediate cavity (and irises) defines a second such path.

Preferably in this form of our invention first and second filter functions are applied to the radiation in passage along the first and second paths respectively; and preferably the first filter function is substantially the same as the second. Preferably both are elliptic or quasi-elliptic.

In one embodiment of this form of our invention, for further response shaping a "second story" of filter structure can be provided by positioning an additional resonant cavity next to the exit cavity. This additional cavity may be displaced from the exit cavity in a direction perpendicular to the rectangle of the rectangular array, and may in turn act as entry cavity for a second rectangular array receiving radiation from the additional cavity. The second rectangular array—the "second story"—may have a second exit cavity diagonally displaced from the additional cavity.

Yet another form of our invention includes a substantially rectangular array of at least four resonant cavities, with the entry and exit cavities in diagonally opposite corners, and first and second intermediate cavities occupying the two remaining corners. Each of the four cavities is adapted to support resonance of electromagnetic radiation or energy that is linearly polarized in each of three mutually orthogonal directions.

In addition this form of our invention includes a first iris for coupling radiation that is linearly polarized in each of two mutually orthogonal directions, from the entry cavity into the first intermediate cavity. It also includes a second iris for coupling radiation that is linearly polarized in substantially one direction exclusively, from the first intermediate cavity into the exit cavity.

This form of the invention also includes a third iris for coupling radiation that is linearly polarized in substantially one direction exclusively, from the entry cavity into the second intermediate cavity. It also includes a fourth iris for coupling radiation that is linearly polarized in each of two mutually orthogonal directions, from the second intermediate cavity into the exit cavity.

All of the foregoing operational principles and advantages of the present invention will be more fully appreciated upon consideration of the following detailed description, with reference to the appended drawings, of which:

DETAILED DESCRIPTION OF PREFERRED EMBODIMENT

Figure 1:
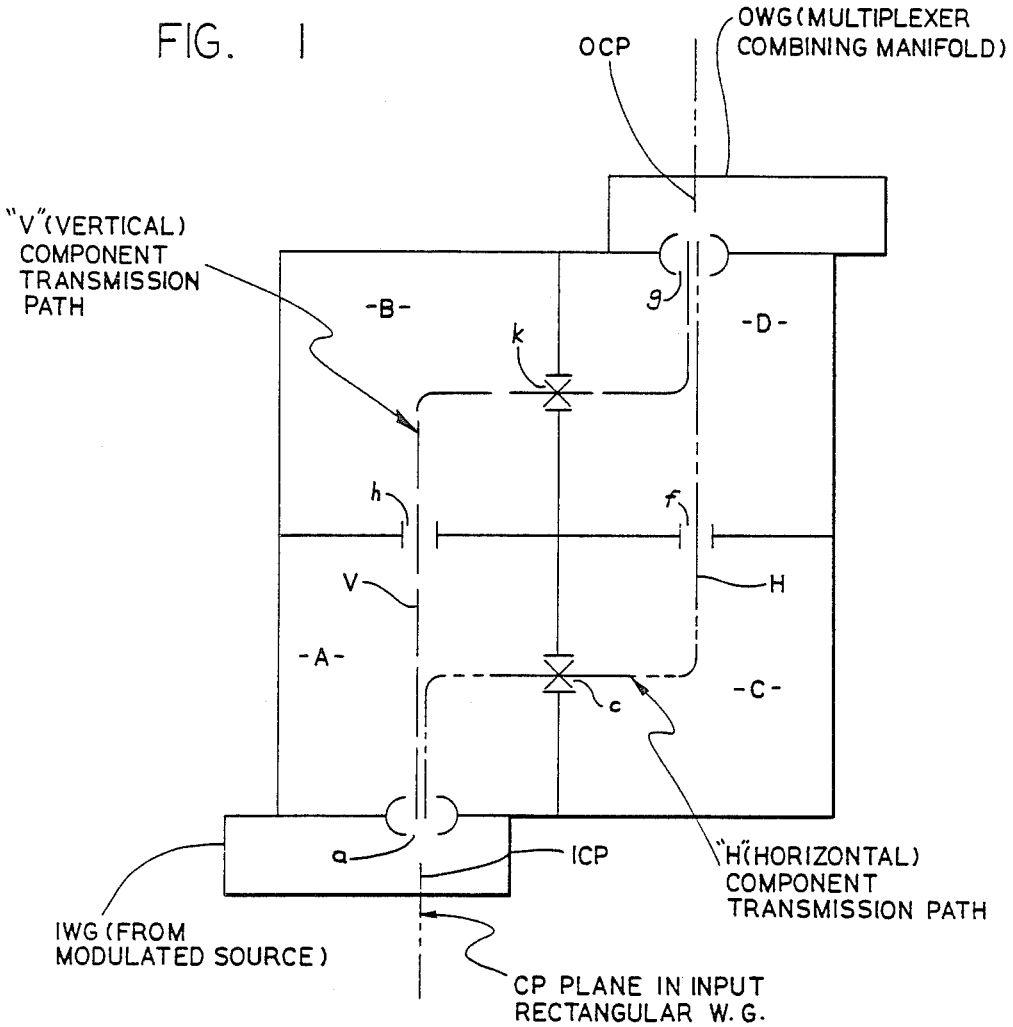
FIG. 1 is a highly schematic plan view of one preferred embodiment of our invention.
Figure 2:
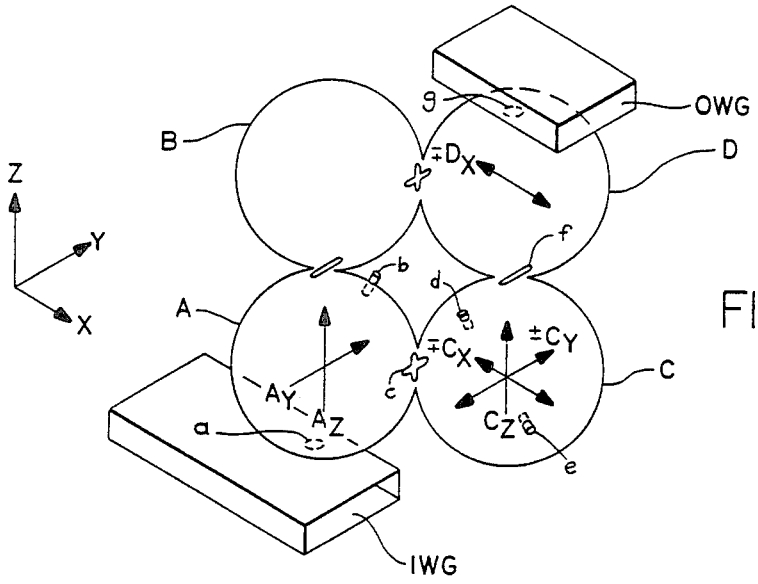
FIG. 2 is a schematic isometric view of the FIG. 1 embodiment showing the orientation and polarity of each resonance in a sequence that is constructed along a first path through a first intermediate cavity.
Figure 3:
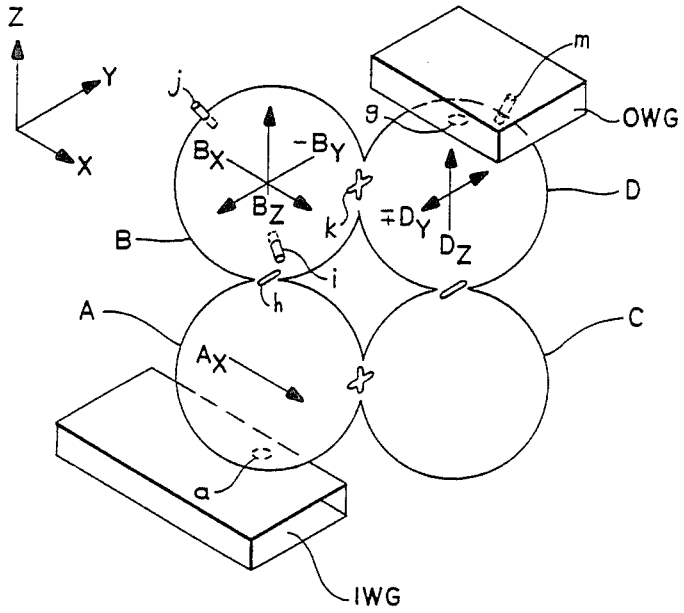
FIG. 3 is a similar schematic isometric view of the FIG. 1 embodiment showing the orientation and polarity of each resonance in a sequence that is constructed along a second path through a second intermediate cavity.

As shown in FIGS. 1 through 3, one preferred embodiment of our invention receives input circularly polarized radiation ICP that is derived from an electromagnetic wavefront propagating longitudinally within an input waveguide IWG. The entry cavity A receives this radiation ICP through an entry iris a, and resolves the radiation ICP into its constituent vertical and horizontal components H and V (FIG. 1).

The resolution of circularly polarized radiation into two orthogonal lineraly polarized components depends upon the well-known fact that a circular path is described by the resultant of two linearly oscillating vectors that have a common frequency but a ninety-degree phse difference. This same relation accounts for the resynthesis of circularly polarized radiation from the two linearly polarized components at the exit iris.

As a practical matter, the resolution of circular into linear polarizations having particular desired orientations occurs as a result of tuning the entry cavity A for resonance in two mutually perpendicular directions, corresponding to the desired orientations of the H and V components. When the cavities are spherical as illustrated in FIGS. 2 and 3, such tuning is effected by adjustment of tuning screws or stubs that protrude inwardly into the entry cavity A.

The positioning and adjustment of such screws is generally known in the production design and tuning of microwave filters and other microwave devices. To avoid unduly cluttering the drawings such screws are not illustrated here, but are to be taken as present. Tuning screws or stubs are required likewise for each of the resonances in all four cavities, and are all omitted from the drawings for the same reason. The previously mentioned patent to Young and Griffin, among other sources, amply illustrates the provision of tuning screws or stubs.

The cavities A through D need not be spheres as illustrated in FIGS. 2 and 3, but may instead be cubes. When cubical cavities are used, the resolution of circularly polarized radiation into linearly polarized components is controlled in part by the orientation of the cubical entry cavity. The tuning stubs must therefore be positioned appropriately with respect to the cubical cavity, as is understood by persons skilled in this art.

The two linearly polarized components H and V introduced in the entry cavity A respectively traverse discrete paths passing through the first and second intermediate cavities C and B to the exit cavity D, where they recombine to resynthesize output circularly polarized radiation OCP. The latter is coupled through an exit iris g to the output waveguide OWG, where there is derived from the circularly polarized radiation OCP an electromagnetic wavefront that propagates longitudinally within that guide OWG.

The direction of propagation of the initial wavefront in the input guide IWG is translated into the sense of circular polarization of the input radiation ICP, which in turn is translated into the algebraic sign of the phase between the linearly polarized components H and V within the entry cavity A. Conversely, the sign of the phase between these components H and V in the exit cavity is translated into the sense of circular polarization of the output radition OCP, which in turn is translated into the direction of propagation of the wavefront in the output guide OWG. Thus the propagation directions in the input and output guides IWG and OWG are uniquely related, provided that the two paths traversed by the linearly polarized components H and V are configured to preserve the phase relationship between these components.

In traversing a first of the two discrete intermediate paths, the radiation passes through a crossed-slot iris c to the first intermediate chamber C, whence it reaches the exit cavity D through a narrow slot iris f. In traversing the second of the two paths, the radiation passes through a narrow slot iris h to the second intermediate chamber B, and then through a crossed-slot iris k to the exit cavity D.

If the drawing of FIG. 1 is inverted—so that the output guide OWG is in the lower left-hand corner—the details appear unchanged although the two paths are interchanged by the inversion. In this sense each path may be regarded as the "inverse" of the other.

Another way to conceptualize the relationship between the two paths is to note that a line running from the bottom left-hand corner to the top right-hand corner of the drawing divides the diagram into two halves which are mirror images of one another, but reversed in order. In this sense each path may be regarded as the "reverse mirror image" of the other.

The relationship expressed in these various ways is important because it represents one way of satisfying the constraint that the processing undergone by the radiation in the two paths be preserved in the original phasing between the two components—that is, the constraint that the input phase between the horizontal and vertical components H and V be reproduced in the exit cavity D.

The plane of the entry iris a in FIG. 1 is perpendicular to the plane of the paper in that drawing, but is the x-y plane as identified in FIGS. 2 and 3. Thus the circularly polarized input radiation ICP is circularly polarized in the x-y plane and when resolved into its linear-polarization components these components are linearly polarized in the x-y plane. In particular the "horizontal" component H of FIG. 1 appears as $A_y$ (FIG. 2), and the "vertical" component V as $A_x$ (FIG. 3).

FIGS. 2 and 3 also show explicitly the dimension in which the input and output guides IWG and OWG are separated, as the z direction.

In the following discussion, for an overview, we will first follow sequences of resonances in the two paths that are slightly simplified. As will be seen, these sequences are closely related to the "bridge" couplings, the "direct" coupling chains being considerably longer.

In the embodiment of FIGS 1 through 5, the first and second physically distinct intermediate resonant cavities C and B are coupled at irises c and h respectively to receive the first and second mutually orthogonal linearly polarized components $A_y$ as $C_y$, and $A_x$ as $B_x$, respectively, from the entry cavity A.

It will be noted that in the drawings the received components $C_y$ and $B_x$ are shown as aligned with the source components $A_y$ and $A_x$ respectively, and having the same phase, polarity or algebraic sign as the source components. As is well known in microwave coupling arts there is a reversal of phase in passing through a thin slot iris such as h in FIG. 3, or equivalently in traversing either leg of a crossed-slot iris such as c in FIG. 2. In constructing the drawings in this document, however, that phase reversal has been disregarded so that attention can be focused on the variations of phase that are deliberately and more importantly introduced, for purposes of the invention. Thus the drawings do not illustrate absolute phase but rather relative phase, or phasing relative to the natural phase encountered in traversing the several apertures of the system.

This embodiment also includes first and second coupling means e and i, respectively associated with each of the first and second intermediate cavities C and B. These are typically coupling stubs or screws that protrude inwardly into the respective cavities. These devices, which must be distinguished from the tuning stubs or screws (not illustrated) discussed earlier, serve as means for coupling some of the radiation component $C_y$ and $B_x$, received in each of those intermediate cavities respectively, to form first and second modified radiation components $-C_x$ and $-B_y$. These modified components are within the respective intermediate cavities C and B, and are orthogonal to the respective received linearly polarized components $C_y$ and $B_x$.

Figure 4:
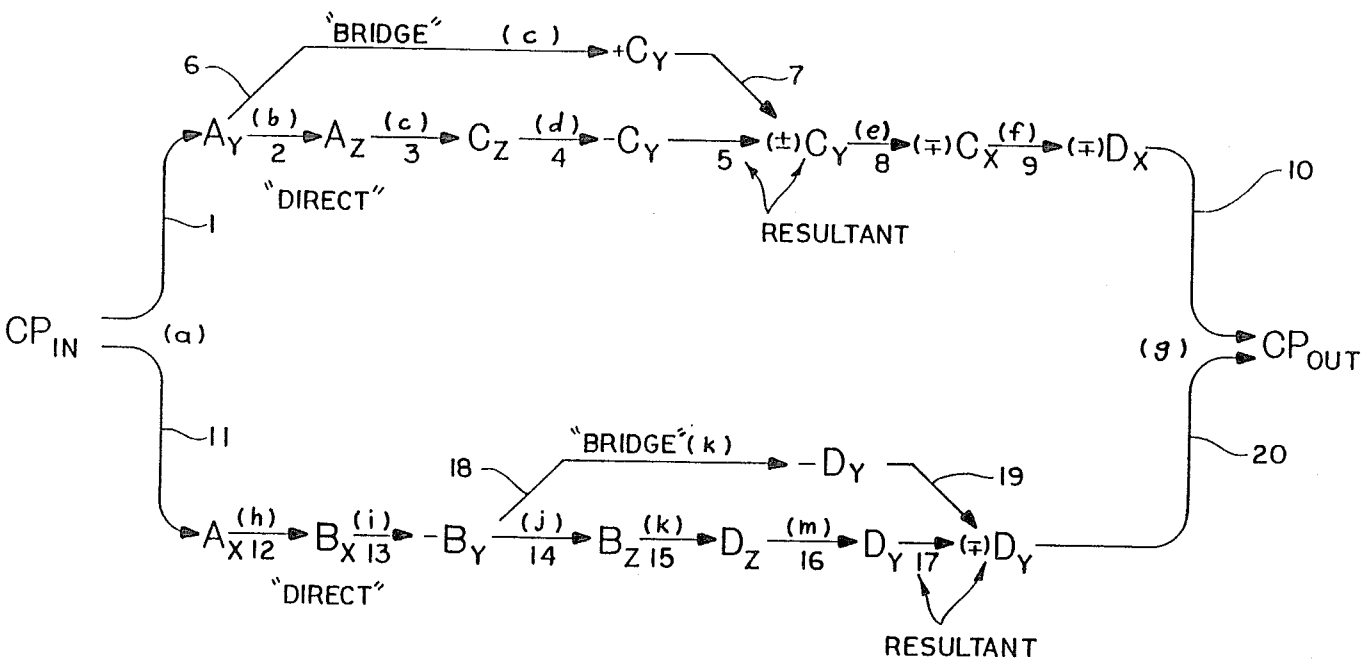
FIG. 4 is a diagram showing the direct and bridge coupling sequences for both the first and second paths.
Figure 5:
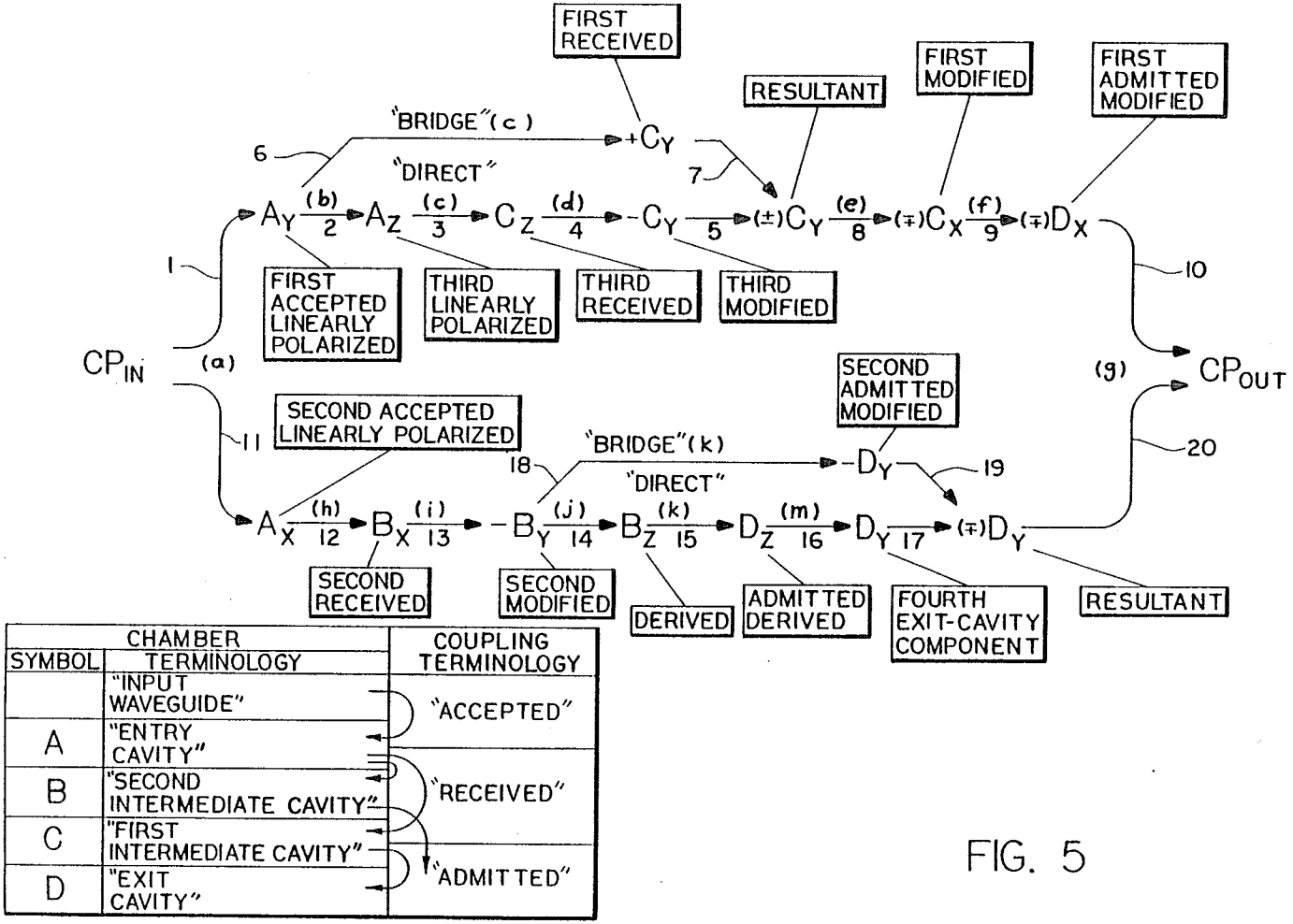
FIG. 5 is a copy of the FIG. 4 diagram, additionally showing the correlation between the terminology used in certain of the appended claims and the resonances and couplings illustrated in FIGS. 1 through 4.

While the second modified component $-B_y$ appears clearly in FIG. 3, the first modified component $-C_x$ appears as the leftward- or negative-pointing end of a two-headed arrow that is marked "$\mp C_x$." Such notations occur at several points in the drawings, for reasons that will be explained. Clarification may be obtained by reference to FIGS. 4 and 5, where the same sequences are diagrammed in a different fashion. In FIGS. 4 and 5 the intercavity coupling irises and the intermode coupling stubs are represented as pathway arrows, keyed to the corresponding features of FIGS. 2 and 3 by lowercase letters in parentheses.

In particular, in FIGS. 4 and 5 the resolution of circularly polarized input radiation $CP_{in}$ is represented by paths or couplings 1 and 11 that lead to the respective components $A_y$ and $A_x$ in the entry cavity A. Paths 6 and 12 in FIGS. 4 and 5 are the couplings through irises c and h respectively, to produce the first and second "received" components $C_y$ and $B_x$ already mentioned. The coupling of energy from these resonances into the first and second "modified" components $-C_x$ and $-B_y$ appear in FIGS. 4 and 5 as path 7-8 and path 13 respectively. The reason for the two-step appearance of path 7-8 will become clear shortly.

To achieve these characteristics the coupling stubs generally are positioned, as best seen in FIGS. 2 and 3, at forty-five degrees to the direction of linear polarization of the received components $C_y$ and $B_x$, in the plane defined by the polarization directions of the received and modified components—i.e., the x-y plane in both cases under consideration. In other words, as can be seen from these drawings, the coupling stub e in the first intermediate cavity C is in the plane defined by (1) the polarization vector $C_y$ that is received, and (2) the modified-radiation polarization vector $-C_x$ that is desired—and is rotationally halfway between the orientations of these two vectors.

Similarly the coupling stub i in the second intermediate cavity B is in the plane defined by the polarization vector $B_x$ that is received and the modified vector $-B_y$ that is desired.

The polarity of all the vectors illustrated in these drawings is a very important consideration. Both the stubs e and i, it will be noticed, have been placed in quadrants of the x-y plane that cause the modified vectors to be negative, as the coordinate system is defined.

Of course this definition of coordinates is arbitrary, but within this coordinate system the negative values of certain vectors are in contrast to positive values produced by other coupling sequences, for reasons already indicated. For the particular illustrated positioning of the coupling screws or stubs, such polarity differences will be preserved regardless of the coordinate system adopted.

In theory the same effects can be developed through alternative placement of coupling screws or stubs diametrically across the cavity from the positions illustrated; in practice, however, for optimum filter performance it is desirable to provide coupling screws or stubs in pairs, at both diametrical positions.

As previously mentioned, although the modified components are orthogonal geometrically in the illustrated embodiment, this is merely an example of the various kinds of orthogonality that can be employed.

The exit resonant cavity D is coupled at f and k respectively to admit the first and second modified radiation components $-C_x$ as $-D_x$, and $-B_y$ as $-D_y$, from the respective first and second intermediate cavities C and B. In FIGS. 4 and 5 these couplings appear as paths 9 and 18. (As previously mentioned, considering our invention in general terms, it would be equivalent for the exit cavity D to admit instead components developed from the first and second modified components $-C_x$ and $-B_y$—as, for example, by interposition of additional resonant modes or even additional cavities.) The exit cavity D is adapted to synthesize circularly polarized radiation from the first and second admitted modified radiation components $-D_x$ and $-D_y$, as represented in FIGS. 4 and 5 by coupling paths 10 and 19-20, for coupling at g to the output waveguide.

The two-step characteristic of coupling 19-20, as well as that of coupling 7-8 mentioned earlier, arises from the fact that the intermediate resonance $\pm C_y$ and $\mp D_y$ in each of these couplings is a sum or resultant produced as the additive result of the "bridge" coupling sequences already discussed with the "direct" coupling sequences also illustrated in the drawings. The notations $\pm C_y$, $\mp C_x$ and like terms are used in this document to represent resonances that may be either positive or negative, but that are forced to be extremely small by combination of two approximately equal components of opposite polarity or phase.

The foregoing "overview" section has focused upon the bridge couplings. Next we will discuss the direct couplings and their relationships to the bridge couplings.

To see how the direct couplings are produced, it must first be noted that the preferred embodiment under discussion also has third coupling means, associated with the second intermediate cavity B. These third coupling means are provided for the purpose of coupling a portion of the second modified component $-B_y$ within the second intermediate cavity to form a derived component $B_z$ within the second intermediate cavity. Typically the third coupling means, like those discussed earlier, is a coupling screw or stub j, appearing as path 14 in FIGS. 4 and 5. As seen in those diagrams, this formation of the derived component $B_z$ is the first step in the "direct" coupling sequence for the second intermediate cavity B.

The resulting derived component $B_z$ is made orthogonal to both the received component $B_x$ and the second modified component $-B_y$, typically by the earlier-described technique of positioning the coupling stub j in the plane defined by (1) the second modified component $-B_y$ that is already present and (2) the derived component $B_z$ that is desired. The stub is at forty-five degrees to both these vectors—that is to say, rotationally halfway between them—and as in the cases previously discussed is in a quadrant that produces a phase reversal or polarity shift as between the second modified component $-B_y$ and the derived component $B_z$. It should be noticed, however, that the relative phase as between the second received component $B_x$ and the derived component $B_z$, after two phase reversals, is now zero.

In this embodiment the exit resonant cavity D is also coupled at k to admit the derived component $B_z$ as $D_z$ from the second intermediate cavity B. In FIGS. 4 and 5 this step appears as coupling 15. This embodiment further comprises exit-cavity coupling means, typically another coupling stub m, for coupling the admitted derived component $D_z$ within the exit cavity into a fourth exit-cavity component $D_y$ that is within the exit resonant cavity D. In this instance the coupling stub m is positioned to produce no phase reversal; hence the relative phase as between the second received component $B_x$ and the fourth exit-cavity component $D_y$ is zero.

The fourth exit-cavity component $D_y$ is polarized parallel to the second admitted modified component $-D_y$, but because of the positioning of the previously discussed coupling stubs i, j and m these two components are of opposite sense. It will be understood that these two components cannot actually coexist independently since they are in the same mode—more specifically here, the same linear polarization condition.

If desired both these components $D_y$ and $-D_y$ may be regarded as virtual components; in any event, what must actually exist is the resultant $\mp D_y$ of the second admitted modified component $-D_y$ and the fourth exit-cavity component $D_y$. This resultant is far smaller than either of the components that produce it, since the two components are of nearly equal amplitude and opposite sign or phase. It is this resultant, rather than the second admitted modified component $-D_y$ alone, that is combined with the first admitted modified component $-D_x$ to synthesize circularly polarized radiation for coupling at g to the output waveguide OWG. Of course the effects of both components are felt in the combination.

Now we turn to the direct coupling sequence in the second path, that which traverses the first intermediate cavity C. This embodiment of our invention also includes entry-cavity coupling means b for coupling a portion of the first linearly polarized component $A_y$ within the entry cavity A into a third linearly polarized component $A_z$. This coupling appears at path 2 in FIGS. 4 and 5. The resulting component $A_z$ is also within the entry cavity and is mutually orthogonal with respect to both the first and second components $A_y$ and $A_x$.

Moreover, the third linearly polarized component $A_z$ within the entry cavity is also coupled at iris c into the first intermediate cavity C to form therein a third received component $C_z$. This step is seen at path 3 in FIGS. 4 and 5. The third received component $C_z$ is orthogonal to both the first received component $C_y$ and the first modified component $-C_x$, within the first intermediate cavity.

This embodiment further includes fifth coupling means, associated with the first intermediate cavity C, for coupling part of the third received component $C_z$ into a third modified linearly polarized component $-C_y$ that is within the first intermediate cavity C and is polarized parallel to the first received component $C_y$. These fifth coupling means are typically another coupling stub d, positioned in the plane defined by the existing third received component and the desired third modified component, but here with a reversal of phase. In FIGS. 4 and 5 the fifth coupling means are represented by path 4. Due to the phase reversal, the third modified component $-C_y$ though parallel to the first received component $C_y$ is of opposite sense.

As already suggested, in this embodiment the first received component $C_y$ and the third modified component $-C_y$ combine within the first intermediate cavity C. It is their much smaller resultant $\pm C_y$ which is coupled by the first coupling means e to form the first modified component $\mp C_x$ and therefrom the first admitted modified component $\mp D_x$.

The filter function obtainable with this device is described in theoretical terms as "of order six." It is to be understood, without a detailed discussion of the meaning of this terminology, that filter functions of higher "order" are more amenable to shaping of sharp cutoffs, through skillful tuning. The "order six" performance of this embodiment of our invention may be compared with the performance of a hybrid filter made as described by Gruner and Williams. Such a hybrid filter having two chambers in each side—for a total of four chambers plus two hybrids —is only of order four.

A hybrid filter of the type introduced by Gruner and Williams can be made to have order six, but requires a larger number of chambers—generally three on each side, for a total of six chambers plus two hybrids.

Our invention makes it possible to achieve order-six performance with only four chambers and no hybrid. In addition, our invention typically presents a loss of only 0.02 to 0.03 dB loss to upstream signals passing the exit iris g of each filter, so that the cumulative loss for the furthest-upstream channel in a ten-channel system is only 0.2 to 0.3 dB. In the system of Gruner and Williams, by contrast, the loss in passing through each hybrid is typically 0.1 dB, for a cumulative loss—as seen by the furthest-upstream channel in a ten-channel system—of one decibel or more.

Figure 6:
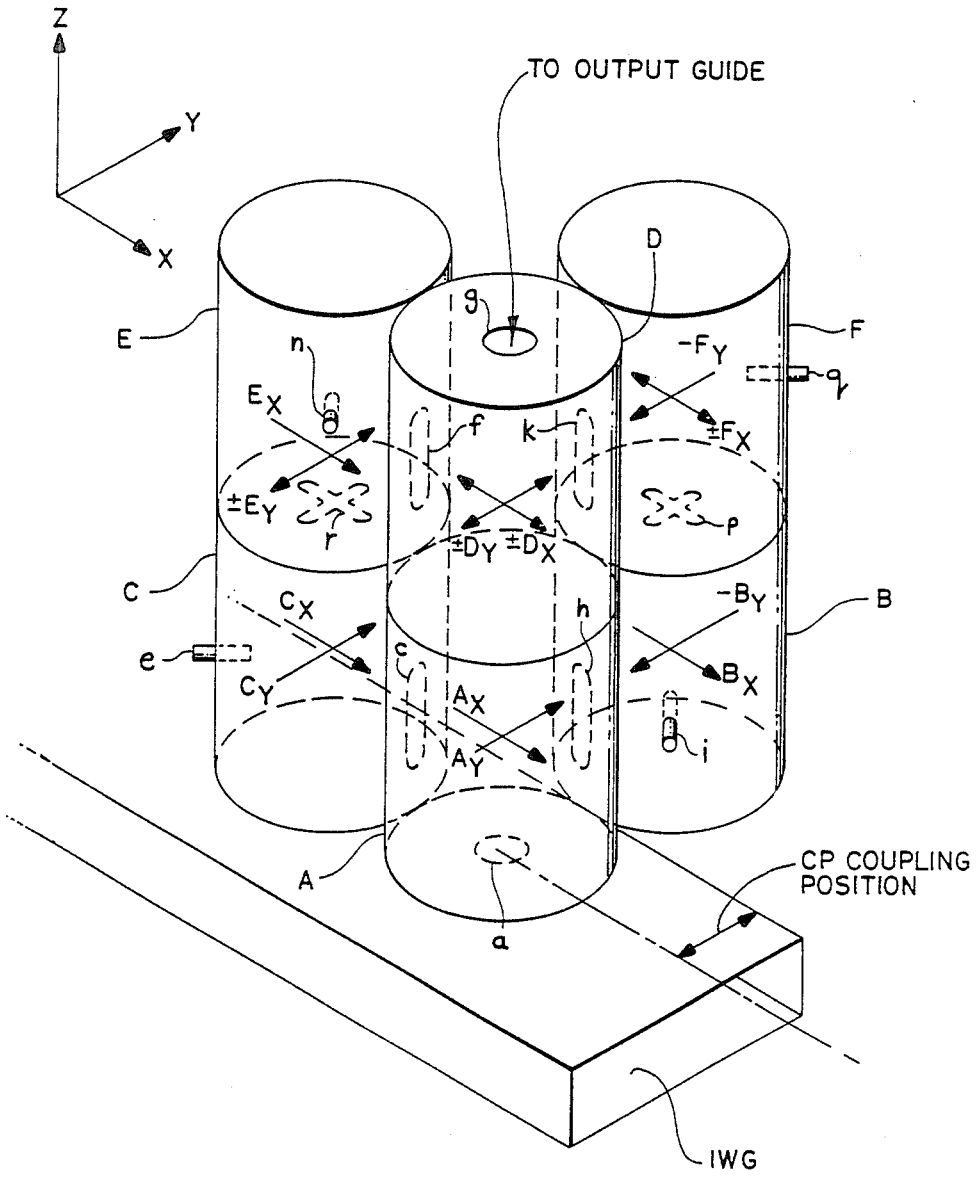
FIG. 6 is a schematic isometric, analogous to FIGS. 2 and 3, of another preferred embodiment of our invention.

FIG. 6 illustrates another preferred embodiment of our invention, which has several practical advantages relative to the first preferred embodiment described above, though not as completely advantageous in terms of rock-bottom minimum hardware as the first embodiment.

This embodiment is an assemblage of six cylindrical cavities A through F, with associated intercoupling irises and coupling stubs. The reference symbols used in FIGS. 6 and 7 these components include most of those used in FIGS. 1 through 5, and in particular the same symbols are used for the entry cavity A, first and second intermediate cavities C and B, and the associated irises and stubs, as well as the exit cavity D.

Hence the "overview" portion of the foregoing discussion of the FIG. 1 embodiment, focusing upon the bridge couplings, applies equally well to the FIG. 6 embodiment, with two exceptions. First, in FIG. 6 the "first modified component" $C_x$ is positive; and second, it is not the resultant of a bridge coupling, and therefore is not shown with an appended minus-or-plus sign ("$\mp$"). The detailed discussion of FIG. 6 will therefore pick up where the earlier "overview" discussion ended.

(In certain of the appended claims, reference symbols are presented in parentheses for keying of the claim language to features shown in the drawings. It is to be understood that these symbols are presented only as examples to aid in following and understanding the claims, because of the difficulty of this subject matter and the great number of different electromagnetic components involved. These symbols are not to be taken as limiting the claims in the slightest, but only as examples. In view of the use of symbols in FIGS. 6 and 7 that correspond to those in FIGS. 1 through 5, the parenthetical reader-aid reference symbols in certain of the appended claims will likewise be found applicable to both embodiments—as is appropriate for claims that are directed to both embodiments.)

The embodiment of FIG. 6 includes at least third and fourth intermediate resonant cavities E and F, respectively coupled for intake of the first and second modified radiation components $C_x$ as $E_x$, and $-B_y$ as $-F_y$, from the respective first and second intermediate cavities C and B. These steps can also be followed in FIGS. 7 and 8 as paths 104 and 114—and of course the earlier portions of the sequences in both sides of the system can also be followed in FIGS. 7 and 8 as paths 101 through 103, and 111 through 113.

The third and fourth intermediate cavities E and F are also adapted to develop from the modified components $E_x$ and $-F_y$ two additional components $-E_y$ and $-F_x$ respectively. In FIG. 6 these "developed" components $-E_y$ and $-F_x$ may be identified as the leftward-pointing ends of the two-headed vectors marked $\pm E_y$ and $\pm F_x$ respectively. These steps in the sequences at both sides of the system can also be seen at 105 and 115.

In the "overview" portion of the FIG. 1 discussion it was mentioned that the exit cavity D could admit components developed from the modified components, rather than the modified components directly. This is the case in the embodiment of FIG. 6, where the developed components $-E_y$ and $-F_x$ are admitted through irises f and k to the exit cavity D as $-D_y$ and $-D_x$ respectively.

Figure 7:
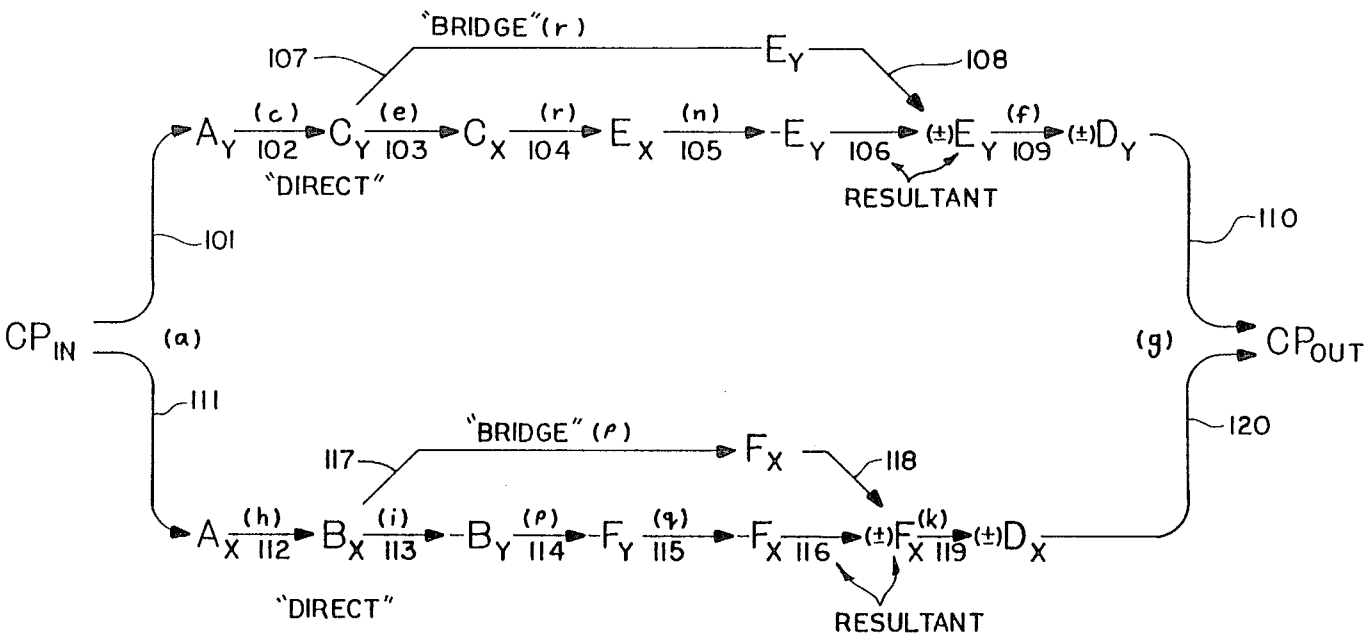
FIG. 7 is a coupling-sequence diagram, similar to FIG. 4, illustrating the direct and bridge couplings for the FIG. 6 embodiment.
Figure 8:
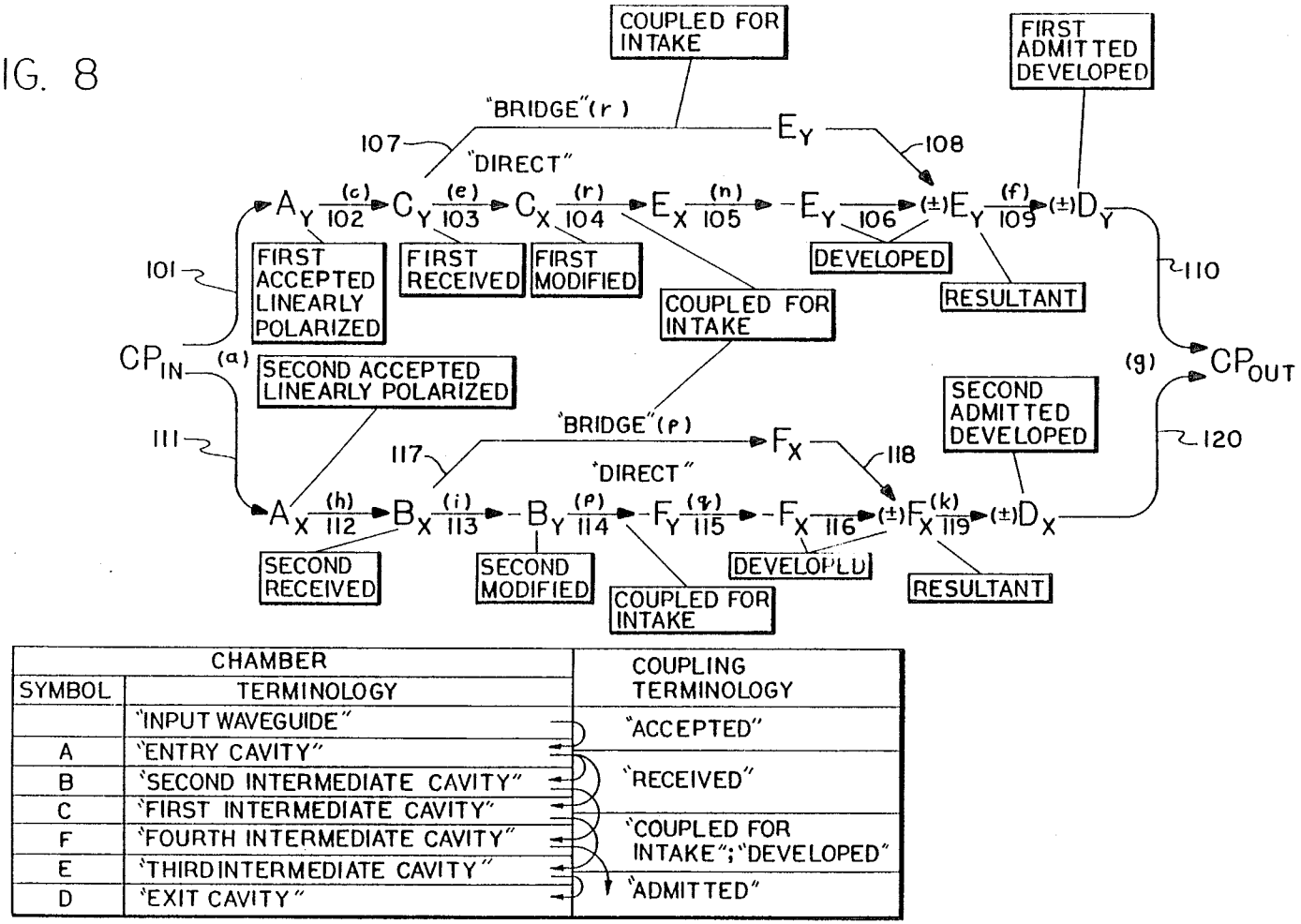
FIG. 8 is an elaborated diagram, similar to Fi correlating the terminology of certain appended claims with the resonances and couplings illustrated in FIGS. 6 and 7.

In FIGS. 7 and 8 these couplings appear at 106–109 and 116–119. As in the diagrams of the FIG. 1 system, these couplings are illustrated in two-step form because of the intervening resultants $\pm E_y$ and $\pm F_x$. The resultants arise by virtue of the bridge-coupling paths 107–108 and 117–118 through the crossed-slot irises r and p. These bridge couplings produce positive virtual components $E_y$ and $F_x$, which are in the same cavities and have the same orientations as the earlier-mentioned "developed" components $-E_y$ and $-F_x$.

Components that share modes in this way necessarily combine to produce the relatively small-amplitude resultants $\pm E_y$ and $\pm F_x$. These are used to provide attenuation maxima that sharply cut off the response of the overall device in the desired manner of an elliptic or quasi-elliptic function.

In the FIG. 6 embodiment each of the six cavities A through F supports electromagnetic resonance in at least two mutually orthogonal modes during operation of the filter. More particularly the number of modes in the illustrated form of this preferred embodiment is precisely two, and the modes are mutually orthogonal polarization directions x and y.

The FIG. 6 embodiment has four advantages relative to the FIG. 1 embodiment. Some of these are advantages with respect to the use of spherical cavities in this embodiment, others with respect to the use of cubical cavities, and still others with respect to both. First, the overall power loss within the filter—for given power flow—can be reduced through the use of cylindrical resonators.

Dissipative loss arises in a resonant microwave cavity primarily because of resistance to the flow of currents induced in the cavity walls. Generally speaking such loss is associated with the wall area, and so is very generally proportional to the total wall area. The power flow through the filter, however, is related to the amount of energy that can be contained within the cavity, and this is very generally proportional to the volume of the cavity. The ratio of power flow to loss, as well as the Q or quality ratio of the filter, is therefore proportional to the ratio of volume to area for the chamber. Any means of increasing this latter ratio results in a lower-loss filter.

A spherical cavity, among all chamber geometries, is generally said to have highest Q and lowest losses of all closed, regular three-dimensional forms configured for resonance in the "fundamental" mode. This last constraint, however, the use of the fundamental mode, is not necessary. When the use of other modes is considered, preference shifts to the use of chambers that are extended in one direction. In the ratio of volume to area for such a chamber, the relatively fixed area of the end walls is in effect distributed over an arbitrarily increasable volume.

Thus the ratio of volume to surface in a sphere is fixed at $D/6=0.17$ D (the symbol "D" representing diameter), and in a cube is fixed at $S/6=0.17$ S ("S" representing the side of the cube), but the same ratio in a cylinder with height equal to a multiplier n times the diameter is $nD/(4n+2)$. For relatively large values of n, this ratio approaches $D/2=0.25$.

Hence the cylindrical resonators of FIG. 6 can be configured to resonate in, for example, the TE113 mode—i. e., with the electrically effective diameter of each cylinder equal to one half-wavelength and the electrically effective height equal to three half-wavelengths. The height here is three times the diameter ($n=3$), the volume-to-surface area is 3D/14 or 0.21 R, and the practically attainable Q for three dual-mode resonators is roughly 18,000. The latter figure may be compared with roughly 12,000 for three tri-mode resonators.

A second advantage of the FIG. 6 embodiment is relative to the use of spheres as shown in FIGS. 1 through 3. This advantage is economy of cavity manufacture. For microwave work, spherical chambers are made by centerless grinding and cylindrical chambers by drilling. The cost of centerless grinding is many times the cost of drilling.

A third advantage is relative to the use of cubical cavities instead of spheres, but still in the orientation of FIGS. 1 through 3. Cubical cavities are more economical to manufacture than spherical cavities; however, as a practical matter it is very awkward to provide the necessary tuning and coupling stubs in a rectangular array of cubical cavities, since such an array is space-filling.

In a rectangular array of spherical cavities, although installation and adjustment of stubs is slightly awkward there is some free space for access at the center of the array. Such access space is absent in an array of cubes. For best adjustability there should be eight stubs per chamber, and in a cubical-cavity array it is extremely difficult to provide more than about five. In the cylindrical configuration of FIG. 6 the provision and adjustment of stubs is far easier.

Figure 9:
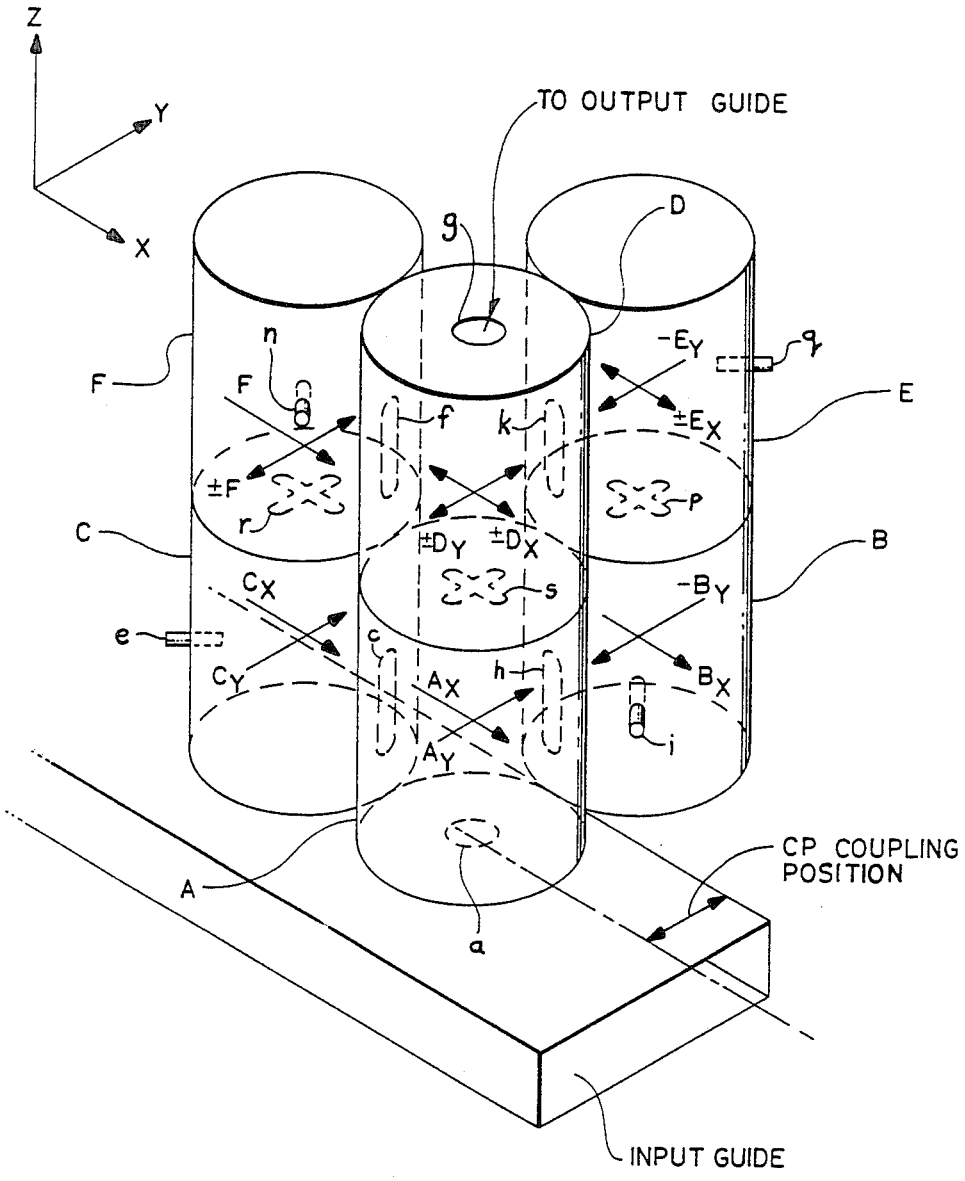
FIG. 9 is a schematic isometric, analogous to FIGS. 2, 3 and 6, of another form of the FIG. 6 embodiment.
Figure 10:
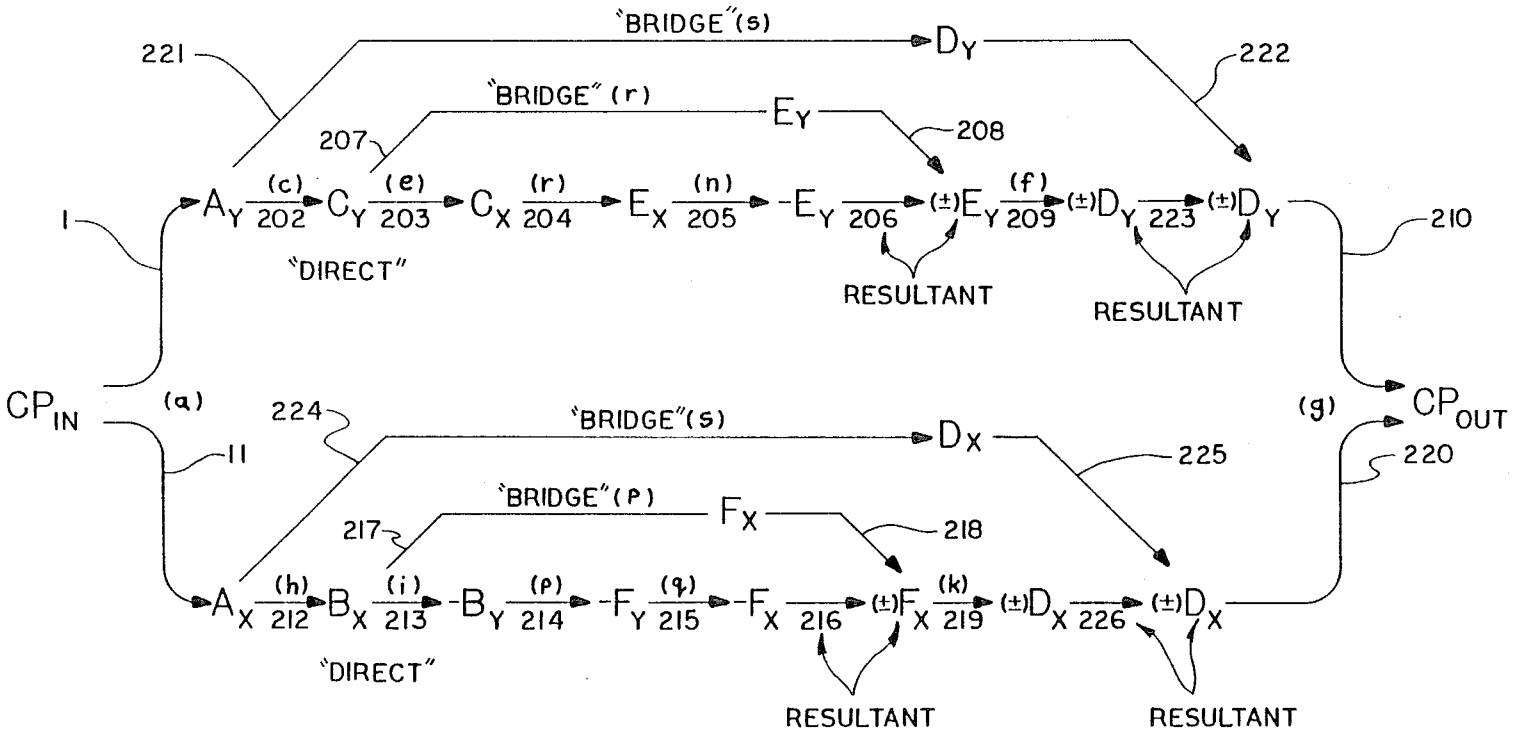
FIG. 10 is a coupling-sequence diagram, similar to FIGS. 4 and 7, illustrating the couplings for the FIG. 9 embodiment.

The fourth advantage of the general geometry of FIG. 6 is that an even more highly controllable filter function can be obtained by addition of another coupling iris—between the entry and exit cavities A and D. This refinement is shown at s in FIG. 9, and the resulting additional pair of bridge couplings appears in FIG. 10 at 221–222 and 224–225. The filter of FIGS. 9 and 10 is of the same "order" as those in the earlier drawings, but is capable of adjustment to develop a larger number of attenuation maxima—for sharper cutoff—or of attenuation minima for use in phase equalization.

It is believed that the foregoing discussion explains the preferred embodiments of our invention in sufficient detail to enable a skilled technician in the microwave-communications assembly and operation field to build and operate an apparatus in accordance with our invention, at least with the guidance of a microwave-communications design engineer at the routine-design level.

It is to be understood that all of the foregoing detailed descriptions are by way of example only, and not to be taken as limiting the scope of our invention—which is expressed only in the appended claims.

We claim:

1. A filter for frequency-selective coupling of electromagnetic radiation from an input waveguide to an output waveguide; said filter comprising:

an array of at least four resonant cavities (A, B, C and D) including an entry cavity (A), an exit cavity (D), and at least first and second intermediate cavities (C and B), each supporting electromagnetic resonance in each of three mutually orthogonal modes (polarization directions x, y and z), during operation of the filter;

the entry and exit cavities (A and D), together with the first intermediate cavity (C) and mode-selective irises (c and f) therebetween, defining a first path (A-c-C-f-D) for transmission of electromagnetic radiation from the entry cavity (A) to the exit cavity (D);

the entry and exit cavities (A and D), together with the second intermediate cavity (B) and mode-selective irises (h and k) therebetween, defining a second path (A-h-B-k-D) for transmission of electromagnetic radiation from the entry cavity (A) to the exit cavity (D);

electromagnetic radiation in the first and second paths (A-c-C-f-D and A-h-B-k-D) being combined, during operation of the filter, in the exit cavity (D); and each of the first and second paths (A-c-C-f-D and A-h-B-k-D) independently being particularly configured to provide a filter function as between radiation in the entry cavity (A) and radiation in the exit cavity (D).

2. The filter of claim 1, wherein:

the filter function provided in each of the first and second paths (A-c-C-f-D and A-h-B-k-D) is elliptic or quasi-elliptic.

3. The filter of claim 2, wherein:

the elliptic or quasi-elliptic filter function provided in the first path (A-c-C-f-D) is substantially the same as the elliptic or quasi-elliptic filter function provided in the second path (A-h-B-k-D).

4. The filter of claim 1, wherein the entry cavity (A) is particularly positioned relative to such input waveguide, and particularly adapted at an entry iris (a), to accept circularly-polarized radiation from such input waveguide and to resolve such circularly-polarized radiation into two entry components ($A_x$ and $A_y$) linearly polarized in two mutually orthogonal directions (x and y);

the two linearly polarized entry components ($A_x$ and $A_y$) form two of the said three mutually-orthogonal-mode resonances in the entry cavity (A);

the two linearly polarized components ($A_x$ and $A_y$) and components respectively derived therefrom ($A_z$, $C_z$, $\pm C_y$ and $\mp C_x$ from $A_x$; and $B_x$, $-B_y$, $B_z$ and $D_z$ from $A_y$) are coupled via the first and second paths respectively to form two respective exit components $\mp D_x$ and $\mp D_y$) in the exit cavity (D) that are linearly polarized in two mutually orthogonal directions (x and y);

the two linearly polarized exit components $\mp D_x$ and $\mp D_y$) forming two of the said three mutually-orthogonal-mode resonances in the exit cavity (D);

the exit cavity (A) is particularly positioned relative to such exit waveguide, and particularly adapted, to combine the two exit components $\mp D_x$ and $\mp D_y$) in the exit cavity (D) to form circularly polarized radiation and to couple such circularly polarized radiation at an exit iris (g) to such output waveguide; and the second path (A-h-B-k-D) is substantially the inverse of the first path (A-c-C-f-D);

whereby combined radiation in the exit cavity (B) is circularly polarized, with the same polarization sense as the radiation accepted at the entry iris (a), at an exit iris (g) whose position is substantially the inverse of the entry-iris (a) position.

5. The filter of claim 4, wherein:

the filter function provided in each path (A-c-C-f-D) or (A-h-B-k-D) is elliptic or quasi-elliptic; and the elliptic or quasi-elliptic filter function provided in the first path (A-c-C-f-D) is substantially the same as the elliptic or quasi-elliptic filter function provided in the second path (A-h-B-k-D).

6. The filter of claim 1, wherein the array contains precisely four resonant cavities (A, B, C and D); and the said intermediate cavities consist of precisely two intermediate cavities, namely said first and second intermediate cavities (C and B).

7. The filter of claim 2, wherein:

the array contains precisely four resonant cavities (A, B, C and D); and the said intermediate cavities consist of precisely two intermediate cavities, namely said first and second intermediate cavities (C and B).

8. The filter of claim 4, wherein:

the array contains precisely four resonant cavities (A, B, C and D); and the said intermediate cavities consist of precisely two intermediate cavities, namely said first and second intermediate cavities (C and B).

9. The filter of claim 1, wherein:

the said three mutually orthogonal resonance modes supported by each cavity are respectively three mutually orthogonal linear-polarization directions.

10. The filter of claim 2, wherein:

the said three mutually orthogonal resonance modes supported by each cavity are respectively three mutually orthogonal linear-polarization directions.

11. The filter of claim 4, wherein:

the said three mutually orthogonal resonance modes supported by each cavity are respectively three mutually orthogonal linear-polarization directions.

12. The filter of claim 6, wherein:

the said three mutually orthogonal resonance modes supported by each cavity are respectively three mutually orthogonal linear-polarization directions.

13. A directional filter for frequency-selective coupling of electromagnetic radiation from an input waveguide to an output waveguide; said filter comprising:

a substantially rectangular array of at least four resonant cavities (A, B, C and D), including:

an entry cavity (A) and an exit cavity (D) occupying respective corners of the array that are diagonally opposite, and particularly adapted respectively to receive such radiation from such input waveguide and to direct such radiation into such output waveguide, and first and second intermediate cavities (C and B respectively) occupying the two remaining corners of the array;

each of the four cavities (A, B, C and D) supporting electromagnetic resonance in each of three mutually orthogonal modes (polarization directions x, y and z), in operation of the filter;

the entry and exit cavities (A and D), together with the first intermediate cavity (C) and mode-selective irises (c and f) therebetween, defining a first path (A-c-C-f-D) for transmission of radiation from the entry cavity (A) to the exit cavity (D); and the entry and exit cavities (A and D), together with the second intermediate cavity (B) and mode-selective irises (h and k) therebetween, defining a second path (A-h-B-k-D) for transmission of radiation from the entry cavity (A) to the exit cavity (D).

14. The filter of claim 13, wherein:

a first frequency-selective filter function is applied to such radiation in passage along the first path (A-c-C-f-D);

a second frequency-selective filter function is applied to such radiation in passage along the second path (A-h-B-k-D); and the first filter function is substantially the same as the second filter function.

15. The filter of claim 14, wherein:

both filter functions are elliptic or quasi-elliptic.

16. The filter of claim 14, wherein:

the array contains precisely four resonant cavities; and both filter functions are elliptic or quasi-elliptic.

17. The filter of claim 13, wherein:

the array contains precisely four resonant cavities; and the filter produces an elliptic or quasi-elliptic filter function as between the received radiation and the directed radiation.

18. The filter of claim 13, wherein:

the second path (A-h-B-k-D) is substantially the inverse of the first path (A-c-C-f-D).

19. The filter of claim 13, also comprising:

an additional resonant cavity displaced from the exit cavity, in a direction perpendicular to the rectangle of the rectangular array, and receiving radiation coupled from the exit cavity; and a second rectangular array of resonant cavities receiving radiation from the additional cavity, and having a second exit cavity diagonally displaced from the additional cavity.

20. The filter of claim 13, wherein:

the radiation received from the input waveguide and the radiation directed into the output waveguide are circularly polarized.

21. The filter of claim 20, wherein:

the circular-polarization sense of the radiation directed into the output waveguide is the same as the circular-polarization sense of the radiation received from the input waveguide.

22. A directional filter for frequency-selective coupling of electromagnetic radiation from an input waveguide to an output waveguide; said filter comprising:

a substantially rectangular array of at least four resonant cavities (A, B, C and D), including:

an entry cavity (A) and an exit cavity (D) occupying respective corners of the array that are diagonally opposite, and particularly adapted respectively to receive such radiation from such input waveguide and to direct such radiation into such output waveguide, and first and second intermediate cavities (C and B respectively) occupying the two remaining corners of the array;

each of the four cavities (A, B, C and D) being particularly adapted to support electromagnetic radiation that is linearly polarized in each of three mutually orthogonal directions (x, y and z);

a first iris (c) for coupling radiation ($A_y$ and $A_z$) that is linearly polarized in each of two mutually orthogonal directions (y and z), from the entry cavity (A) into the first intermediate cavity (C);

a second iris (f) for coupling radiation ($\mp C_x$) that is linearly polarized in substantially one direction (x) exclusively, from the first intermediate cavity (C) into the exit cavity (D);

a third iris (h) for coupling radiation ($A_x$) that is linearly polarized in substantially one direction (x) exclusively, from the entry cavity (A) into the second intermediate cavity (B); and a fourth iris (k) for coupling radiation ($B_y$ and $B_z$) that is linearly polarized in each of two mutually orthogonal directions (y and z), from the second intermediate cavity (B) into the exit cavity (D).

23. The filter of claim 22, wherein:

the one exclusive polarization direction (x) of the second-iris (f) coupling and the one exclusive polarization direction (x) of the third-iris (h) coupling are the same direction.

24. The filter of claim 22, wherein:

the two exclusive polarization directions (y and z) of the first-iris (c) coupling and the two exclusive polarization directions (y and z) of the fourth-iris (k) coupling are the same two directions.

25. The filter of claim 23, wherein:

the two exclusive polarization directions (y and z) of the first-iris (c) coupling and the two exclusive polarization directions (y and z) of the fourth-iris (k) coupling are the same two directions.

26. The filter of claim 22, further comprising:

an entry iris (a) for coupling of circularly polarized microwave radiation from such input waveguide into the entry cavity (A); and an exit iris (g) for coupling of circularly polarized microwave radiation from such exit cavity (D) into the output waveguide.

27. The filter of claim 25, further comprising:

an entry iris (a) for coupling of circularly polarized microwave radiation from such input waveguide into the entry cavity (A); and an exit iris (g) for coupling of circularly polarized microwave radiation from such exit cavity (D) into the output waveguide.

28. The filter of claim 27, wherein:

the first and fourth irises (c and k) are both crossed-slot irises;

the second and third irises (h and f) are both slot irises; and the entry and exit irises (a and g) are both circular irises.

29. The filter of claim 26:

wherein the entry cavity (A) is particularly adapted to resolve the circularly polarized radiation received from the entry iris (a) into two linearly polarized radiation components ($A_y$ and $A_x$) having mutually orthogonal polarization directions (y and x);

a particular one ($A_y$) of said two linearly polarized radiation components ($A_y$ and $A_x$) being polarized in one of the two polarization directions (y) that are coupled by the first iris (c); and further comprising a coupling screw (b) for coupling part of said particular component ($A_y$) into a component of radiation ($A_z$) that is linearly polarized in the other (z) of said two polarization directions.

30. The filter of claim 26 wherein:

the entry cavity (A) is particularly adapted to resolve the circularly polarized radiation received from the entry iris (a) into two linearly polarized radiation components ($A_y$ and $A_x$) having mutually orthogonal polarization directions (y and x); and a particular one ($A_x$) of said two linearly polarized radiation components ($A_y$ and $A_x$) is polarized in the one polarization direction (x) that is coupled by the third iris (h).

31. The filter of claim 29 wherein:

the other particular one ($A_x$) of said two linearly polarized radiation components ($A_y$ and $A_x$) is polarized in the one polarization direction (x) that is coupled by the third iris (h).

32. A directional filter for frequency-selective coupling of circularly polarized electromagnetic radiation from an input waveguide to an output waveguide; said filter comprising:

an entry resonant cavity (A) coupled (a) to accept such circularly polarized radiation from such input waveguide and adapted to resolve the circularly polarized radiation into first and second mutually orthogonal linearly polarized components ($A_y$ and $A_x$ respectively);

first and second physically distinct intermediate resonant cavities (C and B) coupled (c and h respectively) to receive the first and second mutually orthogonal linearly polarized components ($A_y$ as $C_y$, and $A_x$ as $B_x$), respectively, from the entry cavity (A);

first and second coupling means (e and i), respectively associated with each of the first and second intermediate cavities (C and B), for coupling some of the radiation component ($C_y$ and $B_x$ respectively) received in each of those intermediate cavities to form first and second modified radiation components ($-C_x$ and $-B_y$) respectively that are within the respective intermediate cavities (C and B) and that are orthogonal to the respective received linearly polarized components ($C_y$ and $B_x$); and an exit resonant cavity (D), coupled (f and k respectively) to admit the first and second modified radiation components ($-C_x$ as $-D_x$, and $-B_y$ as $-D_y$) from the respective first and second intermediate cavities (C and B), and adapted to synthesize circularly polarized radiation from the first and second admitted modified radiation components ($-D_x$ and $-D_y$) for coupling (g) to such output waveguide.

33. The directional filter of claim 32, also comprising:

third coupling means (j), associated with the second intermediate cavity (B), for coupling a portion of the second modified component ($-B_y$) within the second intermediate cavity to form a derived component ($B_z$) within the second intermediate cavity;

said derived component ($B_z$) being orthogonal to both the received component ($B_x$) and the second modified component ($-B_y$).

34. The directional filter of claim 33:

wherein the exit resonant cavity (D) is also coupled (k) to admit the derived component ($B_z$ as $D_z$) from the second intermediate cavity (B);

further comprising exit-cavity coupling means (m) for coupling the admitted derived component ($D_z$) within the exit cavity into a fourth exit-cavity component ($D_y$) that is within the exit resonant cavity (D) and that is polarized parallel to the second admitted modified component ($-D_y$) but of opposite sense; and wherein it is the resultant ($\mp D_y$) of the fourth exit-cavity component ($D_y$) that is combined with the first admitted modified component ($-D_x$) to synthesize such circularly polarized radiation for coupling (g) to such output waveguide.

35. The filter of claim 34, also comprising:

entry-cavity coupling means (b) for coupling a portion of the first linearly polarized component ($A_y$) within the entry cavity (A) into a third linearly polarized component ($A_z$) that is also within the entry cavity and that is also mutually orthogonal with respect to both the first and second components ($A_y$ and $A_x$).

36. The filter of claim 35:

wherein the third linearly polarized component ($A_z$) within the entry cavity is also coupled (c) into the first intermediate cavity (C) to form therein a third received component ($C_z$) that is orthogonal to both the first received component ($C_y$) and the first modified component ($-C_x$) inthe first intermediate cavity; and further comprising fifth coupling means (d), associated with the first intermediate cavity (C), for coupling part of the third received component ($C_z$) into a third modified linearly polarized component ($-C_y$) that is within the first intermediate cavity (C) and is polarized parallel to the first received component ($C_y$) but of opposite sense.

37. The filter of claim 36, wherein:

the first received component ($C_y$) and the third modified component ($-C_y$) combine within the first intermediate cavity (C), and it is their resultant ($\pm C_y$) which is coupled by the first coupling means (e) to form the first modified component ($\mp C_x$) and therefrom the first admitted modified component ($\mp D_x$).

38. A directional filter for frequency-selective coupling of circularly polarized electromagnetic radiation from an input waveguide to an output waveguide; said filter comprising:

an entry resonant cavity (A) coupled (a) to accept such circularly polarized radiation from such input waveguide and adapted to resolve the circularly polarized radiation into first and second mutually orthogonal linearly polarized components ($A_y$ and $A_x$ respectively);

first and second physically distinct intermediate resonant cavities (C and B) coupled (c and h respectively) to receive the first and second mutually orthogonal linearly polarized components ($A_y$ as $C_y$, and $A_x$ as $B_x$), respectively, from the entry cavity (A);

first and second coupling means (e and i), respectively associated with each of the first and second intermediate cavities (C and B), for coupling some of the radiation component ($C_y$ and $B_x$ respectively) received in each of those intermediate cavities to form first and second modified radiation components ($-C_x$ in FIGS. 2 through 5, or $C_x$ in FIGS. 6 through 10; and $-B_y$) respectively that are within the respective intermediate cavities (C and B) and that are orthogonal to the respective received linearly polarized components ($C_y$ and $B_x$); and an exit resonant cavity (D), coupled (f and k respectively) to admit the first and second modified radiation components ($-C_x$ as $-D_x$, and $-B_y$ as $-D_y$, in reference to FIGS. 2 through 5) from the respective first and second intermediate cavities (C and B), or components respectively developed therefrom ($\pm E_y$ as $\pm D_y$, and $\pm F_x$ as $\pm D_x$, in reference to FIGS. 6 through 10), and adapted to synthesize circularly polarized radiation from the admitted components ($-D_x$ and $-D_y$ in FIGS. 2 through 5; or $\pm D_x$ and $\pm D_y$ in FIGS. 6 through 10) for coupling (g) to such output waveguide.

39. The directional filter of claim 38, also comprising:

third coupling means (j), associated with the second intermediate cavity (B), for coupling a portion of the second modified component ($-B_y$) within the second intermediate cavity to form a derived component ($B_z$) within the second intermediate cavity;

said derived component ($B_z$) being orthogonal to both the received component ($B_x$) and the second modified component ($-B_y$).

40. The directional filter of claim 39:

wherein the exit resonant cavity (D) is also coupled (k) to admit the derived component ($B_z$ as $D_z$) from the second intermediate cavity (B);

further comprising exit-cavity coupling means (m) for coupling the admitted derived component ($D_z$) within the exit cavity into a fourth exit-cavity component ($D_y$) that is within the exit resonant cavity (D) and that is polarized parallel to the second admitted modified component ($-D_y$) but of opposite sense; and wherein it is the resultant ($\mp D_y$) of the second admitted modified component ($-D_y$) and the fourth exit-cavity component ($D_y$) that is combined with the first admitted modified component ($-D_x$) to synthesize such circularly polarized radiation for coupling (g) to such output waveguide.

41. The filter of claim 40, also comprising:

entry-cavity coupling means (b) for coupling a portion of the first linearly polarized component ($A_y$) within the entry cavity (A) into a third linearly polarized component ($A_z$) that is also within the entry cavity and that is also mutually orthogonal with respect to both the first and second components ($A_y$ and $A_x$).

42. The filter of claim 41:

wherein the third linearly polarized component ($A_z$) within the entry cavity is also coupled (c) into the first intermediate cavity (C) to form therein a third received component ($C_z$) that is orthogonal to both the first received component ($C_y$) and the first modified component ($-C_x$) in the first intermediate cavity; and further comprising fifth coupling means (d), associated with the first intermediate cavity (C), for coupling part of the third received component ($C_z$) into a third modified linearly polarized component ($-C_y$) that is within the first intermediate cavity (C) and is polarized parallel to the first received component ($C_y$) but of opposite sense.

43. The filter of claim 42, wherein:

the first received component ($C_y$) and the third modified component ($-C_y$) combine within the first intermediate cavity (C), and it is their resultant ($\pm C_y$) which is coupled by the first coupling means (e) to form the first modified component ($\mp C_x$) and therefrom the first admitted modified component ($\mp D_x$).

44. The filter of claim 38, further comprising:

at least third and fourth intermediate resonant cavities (E and F), respectively coupled for intake of the first and second modified radiation components ($C_x$ as $E_x$, and $-B_y$ as $-F_y$) from the respective first and second intermediate cavities (C and B), and adapted to develop therefrom said developed components ($-E_y$ and $-F_x$) for admission to the exit cavity (D).

45. The filter of claim 44, wherein:

each of the six cavities (A through F) supports electromagnetic resonance in at least two mutually orthogonal modes (polarization directions x and y) during operation of the filter.

46. The filter of claim 44, wherein:

each of the six cavities (A through F) supports electromagnetic resonance in precisely two mutually orthogonal modes (polarization directions x and y) during operation of the filter.

47. A filter for frequency-selective coupling of circularly polarized electromagnetic radiation from an input waveguide to an output waveguide; said filter comprising:

at least six cylindrical resonant cavities (A through F), including:

an entry cavity (A) coupled (a) to accept such circularly polarized radiation from such input waveguide and adapted to resolve the circularly polarized radiation into first and second mutually orthogonal linearly polarized components ($A_y$ and $A_x$ respectively), first and second physically distinct intermediate resonant cavities (C and B) coupled (c and h respectively) to receive the first and second mutually orthogonal linearly polarized components ($A_y$ as $C_y$, and $A_x$ as $B_x$), respectively, from the entry cavity (A), at least third and fourth intermediate resonant cavities (E and F), and an exit resonant cavity (D); and first and second coupling means (e and i), respectively associated with each of the first and second intermediate cavities (C and B), for coupling some of the radiation component ($C_y$ and $B_x$ respectively) received in each of those intermediate cavities to form first and second modified radiation components ($C_x$ and $B_y$) respectively that are within the respective intermediate cavities (C and B) and that are orthogonal to the respective received linearly polarized components ($C_y$ and $B_x$);

said third and fourth cavities (E and F) being respectively coupled for intake of the first and second modified radiation components ($C_x$ as $E_x$, and $-B_y$ as $-F_y$) from the respective first and second intermediate cavities (C and B), and adapted to develop therefrom first and second developed components ($\pm E_y$ and $\pm F_x$) respectively; and said exit cavity being coupled (f and k respectively) to admit the first and second developed radiation components ($\pm E_y$ as $\pm D_y$, and $\pm F_x$ as $\pm D_x$) from the respective third and fourth intermediate cavities (C and B), and adapted to synthesize circularly polarized radiation from the admitted components ($\pm D_y$ and $\pm D_x$) for coupling (g) to such output waveguide.

48. The filter of claim 47, wherein:

each of the six cavities is operated in two modes.

49. A filter for frequency-selective coupling of circularly polarized electromagnetic radiation from an input waveguide to an output waveguide; said filter comprising:

at least four resonant cavities, including:

an entry cavity coupled to accept such circularly polarized radiation from such input waveguide and adapted to resolve the circularly polarized radiation into first and second mutually orthogonal linearly polarized components, first and second intermediate resonant-cavity paths respectively coupled to receive the first and second components, and an exit resonant cavity that is adapted to synthesize circularly polarized radiation from third and fourth mutually orthogonal linearly polarized components formed therein, for coupling to such output waveguide; and coupling means, associated with the cavities, for coupling the first and second components through a respective first series and second series of mutually orthogonal resonances, respectively traversing the intermediate paths, to form respectively said third and fourth components in the exit cavity.

50. The filter of claim 49, wherein:

each of said first series and second series includes at least one direct-coupling series of resonances and at least one bridge-coupling series of resonances;

in each of said first series and second series, the direct-coupling series and the bridge-coupling series both contribute to a resultant resonance, and their respective contributions are mutually opposed in phase.

* * * * *